US010029451B2

(12) United States Patent
Rogers et al.

(10) Patent No.: US 10,029,451 B2
(45) Date of Patent: Jul. 24, 2018

(54) NON-CONTACT TRANSFER PRINTING

(71) Applicant: The Board of Trustees of the University of Illinois, Urbana, IL (US)

(72) Inventors: John A. Rogers, Champaign, IL (US); Placid M. Ferreira, Champaign, IL (US); Reza Saeidpourazar, Nashua, NH (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 15/374,926

(22) Filed: Dec. 9, 2016

(65) Prior Publication Data

US 2017/0210117 A1 Jul. 27, 2017

Related U.S. Application Data

(63) Continuation of application No. 13/549,291, filed on Jul. 13, 2012, now Pat. No. 9,555,644.

(60) Provisional application No. 61/507,784, filed on Jul. 14, 2011, provisional application No. 61/594,652, filed on Feb. 3, 2012.

(51) Int. Cl.
*B41F 16/00* (2006.01)

(52) U.S. Cl.
CPC ..... *B41F 16/00* (2013.01)

(58) Field of Classification Search
CPC .... B81C 2201/0185; B81C 2201/0187; B81C 2201/0188; B81C 2201/0174; B81C 2201/018; B81C 2201/0197; B41F 16/00
See application file for complete search history.

(56) References Cited

U.S. PATENT DOCUMENTS

| | | | |
|---|---|---|---|
| 3,554,125 | A | 1/1971 | Columbus et al. |
| 3,689,935 | A | 9/1972 | Pressman et al. |
| 4,688,050 | A | 8/1987 | Tsao |
| 5,984,443 | A | 11/1999 | Desie et al. |
| 7,255,919 | B2 | 8/2007 | Sakata et al. |
| 7,622,367 | B1 | 11/2009 | Nuzzo et al. |
| 7,927,976 | B2 | 4/2011 | Menard |
| 7,932,123 | B2 | 4/2011 | Rogers et al. |
| 7,943,491 | B2 | 5/2011 | Nuzzo et al. |
| 7,998,528 | B2 | 8/2011 | Hubert et al. |

(Continued)

OTHER PUBLICATIONS

Armani et al. (1999) "Re-configurable fluid circuits by PDMS elastomer Micromachining," *MEMS '99 Twelfth IEEE International Conference*, Orlando, FL, 222-227

(Continued)

*Primary Examiner* — David Banh
(74) *Attorney, Agent, or Firm* — Leydig, Voit & Mayer, Ltd.

(57) ABSTRACT

A transfer printing process that exploits the mismatch in mechanical or thermo-mechanical response at the interface of a printable micro- or nano-device and a transfer stamp to drive the release of the device from the stamp and its non-contact transfer to a receiving substrate are provided. The resulting facile, pick-and-place process is demonstrated with the assembling of 3-D microdevices and the printing of GAN light-emitting diodes onto silicon and glass substrates. High speed photography is used to provide experimental evidence of thermo-mechanically driven release.

30 Claims, 24 Drawing Sheets

(56) References Cited

U.S. PATENT DOCUMENTS

| | | | | |
|---|---|---|---|---|
| 9,555,644 | B2 * | 1/2017 | Rogers | B41J 2/475 |
| 2002/0197401 | A1 | 12/2002 | Auyeung et al. | |
| 2004/0026007 | A1 | 2/2004 | Hubert et al. | |
| 2004/0079464 | A1 | 4/2004 | Kumakura | |
| 2007/0077511 | A1 | 4/2007 | Tredwell et al. | |
| 2009/0199960 | A1 | 8/2009 | Nuzzo et al. | |
| 2009/0217517 | A1 | 9/2009 | Pique et al. | |
| 2009/0258167 | A1 | 10/2009 | Tanaka | |
| 2010/0123268 | A1 | 5/2010 | Menard | |
| 2010/0178722 | A1 | 7/2010 | De Graff et al. | |
| 2011/0297084 | A1 | 12/2011 | Hubert et al. | |
| 2012/0025182 | A1 | 2/2012 | Umeda et al. | |
| 2012/0083099 | A1 | 4/2012 | Nuzzo et al. | |

OTHER PUBLICATIONS

Bohandy et al. (1986) "Metal deposition from a supported metal film using an excimer laser," *J. Appl. Phys*. 60:1538-1539.

Bower et al. (2010) Active-Matrix OLED Display Backplanes Using Transfer-Printed Microscale Integrated Circuits. *Proceeding of the 59th Electronic Component and Technology Conference* , San Diego, CA, USA.

Bulthaup et al. (2001) "Direct Fabrication of All-Inorganic Logic Elements and Microelectromechanical Systems from Nanoparticle Precursors," *Mat. Res. Soc. Symp. Proc*. 636.

California Technical Institute "Gaussian Beam Optics," (2007) http://www.rpgroup.caltech.edu/courses/aph162/2007/Protocols/Optics/e3872_Gaussian-Beam-Optics.pdf; 484-485.

Camino et al. (2001) "Polydimethylsiloxane thermal degradation Part 1. Kinetic aspects," *Polymer* 42:2395-2402.

Chaudhury et al. (1991) "Direct measurement of interfacial interactions between semispherical lenses and flat sheets of poly(dimethylsiloxane) and their chemical derivatives," *Langmuir* 7(5):1013-1025.

Deruelle et al. (1995) "Adhesion at the solid-elastomer interface: influence of the interfacial chains," *Macromolecules* 28:7419-7428.

Freund et al. (2003) *Thin Film Materials—Stress, Defect Formation, and Surface Evolution*. Cambridge University Press, Cambridge, pp. 86-93.

Germain et al. (2007) "Electrodes for microfluidic devices produced by laser induced forward transfer," *Applied Surface Science*, 253:8328-8333.

Green et al. (1995) "Optical Properties of Intrinsic Silicon at 300 K," *Progress in Photovoltaics*, 3(3):189-192.

Holmes et al. (Dec. 1998) "Sacrificial layer process with laser-driven release for batch assembly operations," *J. Microelectromechanical Syst*. 7(4):416-422.

Hsia et al. (2005) "Collapse of stamps for soft lithography due to interfacial adhesion," *Applied Physics Letters* 86(15):154106.

Huang et al. (2005) "Stamp collapse in soft lithography," *Langmuir* 21(17):8058-8068.

Ishikawa et al. (2009) "Transparent Electronics Based on Transfer Printed Aligned Carbon Nanotubes on Rigid and Flexible Substrates," *ACS Nano* 3:73-79.

Kim et al. (2010) "Microstructured Elastomeric Surfaces with Reversible Adhesion and Examples of Their Use in Deterministic Assembly by Transfer Printing," *Proc. Nat. Acad. Sci. USA* 107(40):17095-17100.

Kim et al. (2010) "Waterproof AlInGaP optoelectronics on stretchable substrates with applications in biomedicine and robotics," *Nature Materials* 9:929-937.

Ko et al. (2008) "A Hemispherical Electronic Eye Camera Based on Compressible Silicon Optoelectronics," *Nature* 454:748-753.

Lee et al. (2006) "Bendable GaN High Electron Mobility Transistors on Plastic Substrates," *Journal of Applied Physics* 100(12):124507.

Loo et al. (2003) "Electrical Contacts to Molecular Layers by Nanotransfer Printing," *Nano Letters*, 3(7):913-917.

Martinez (2013) Properties of Solids, http://webserver.dmt.upm.es/~isidoro/dat1/eSol.pdf.

Meitl et al. (2004) "Solution Casting and Transfer Printing Single-Walled Carbon Nanotube Films," *Nano Letters* 4(9):1643-1647.

Meitl et al. (2006) "Transfer Printing by Kinetic Control of Adhesion to an Elastomeric Stamp," *Nature Materials* 5:33-38.

Menard et al. (2004) "Improved Chemistries, Thin Film Deposition Techniques and Stamp Designs for Nanotransfer Printing," *Langmuir*, 20(16):6871-6878.

Okada et al. (1984) "Precise determination of lattice parameter and thermal expansion coefficient of silicon between 300 and 1500K," *J. Appl. Phys*. 56(2):314-320.

Pique et al. (2006) "Laser Forward Transfer of Electronic and Power Generating Materials," Ch14., In; *Laser Ablation and its Applications*, Springer, pp. 339-373.

Saeidpourazar et al. (2012) "A Prototype Printer for Laser Driven Micro-Transfer Printing," *J Manufacturing Processes* 14:416-425.

Saeidpourazar et al. (Oct. 2012) "Laser-driven Non-contact Transfer Placement of Prefabricated Microstructures," *J Microelectromechanical Systems* 21(5):1049-1058.

Stoney GG (1909) "The tension of metallic films deposited by electrolysis," *Proc. R Soc. Lond A* 82(553)172-175.

Sun et al. (2004) "Fabricating Semiconductor Nano/Microwires and Transfer Printing Ordered Arrays of Them onto Plastic Substrates," *Nano Letters*, 4(10):1953-1959.

Suo (1989) "Singularities interacting with interfaces and cracks," *Int. J. Solids Struct*. 25(10):1133-1142.

Wartena et al. (2004) Li-ion Microbatteries Generated by a Laser Direct-Write Method. *Journal of Power Sources*, 126(1-2):193-202.

Yoon et al. (2008) "Ultrathin Silicon Solar Microcells for Semi-transparent, Mechanically Flexible and Microconcentrator Module Designs," *Nat. Mater*. 7:907-915.

Zaumseil et al. (2003) "Three-dimensional and Multilayer Nanostructures Formed by Nanotransfer Printing," *Nano Letters*, 3(9):1223-1227.

International Search Report and Written Opinion, Corresponding to International Application No. PCT/US12/46744, dated Oct. 5, 2012.

* cited by examiner

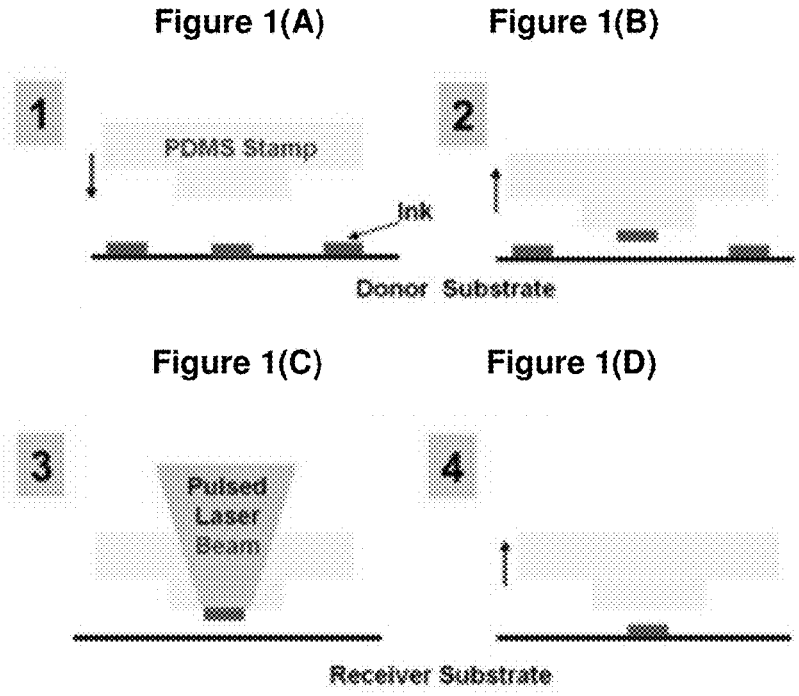
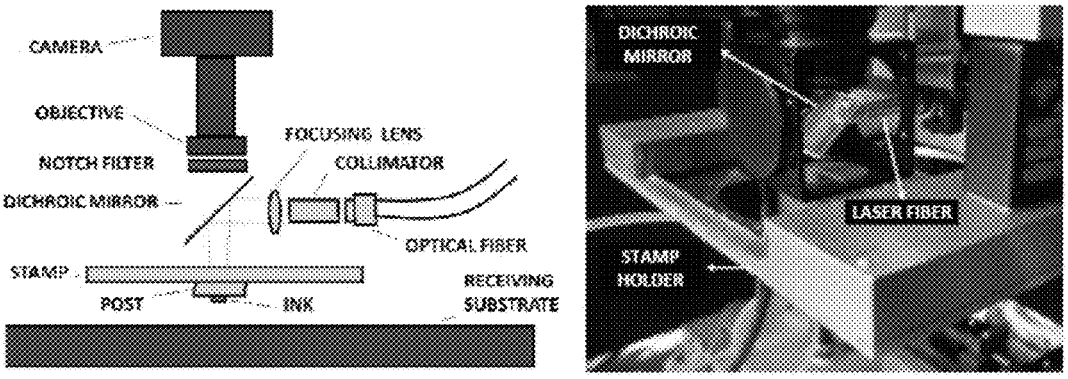
Figure 2

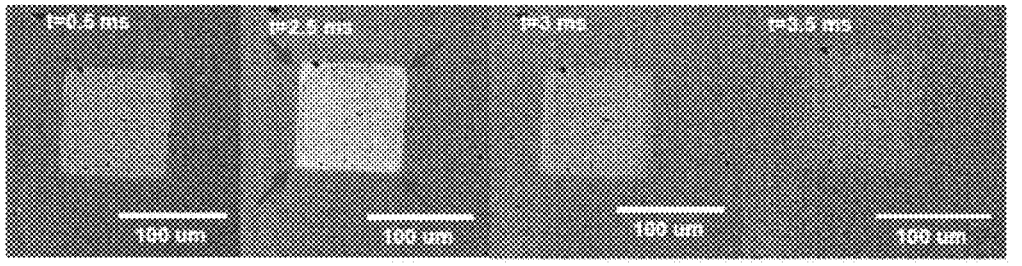
(a)Complete Delamination
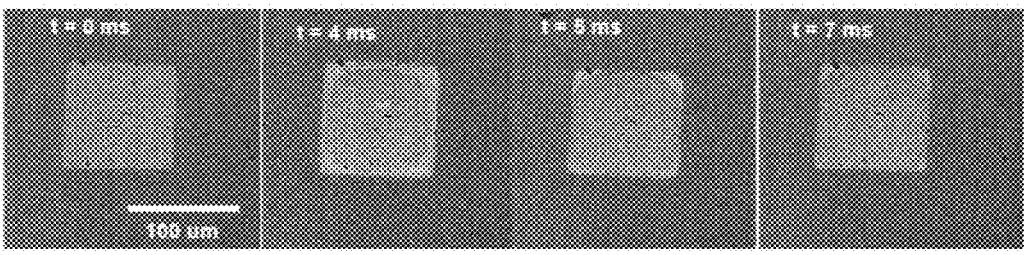
(b) Incomplete Delamination
Figure 5

Figure 9(A)
Figure 9(B)
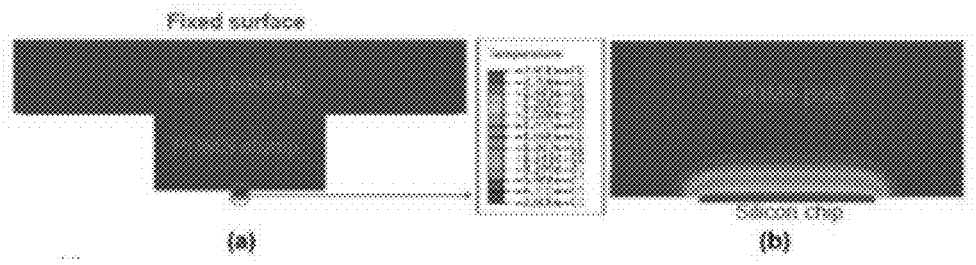
Figure 9(C)
Figure 9(D)
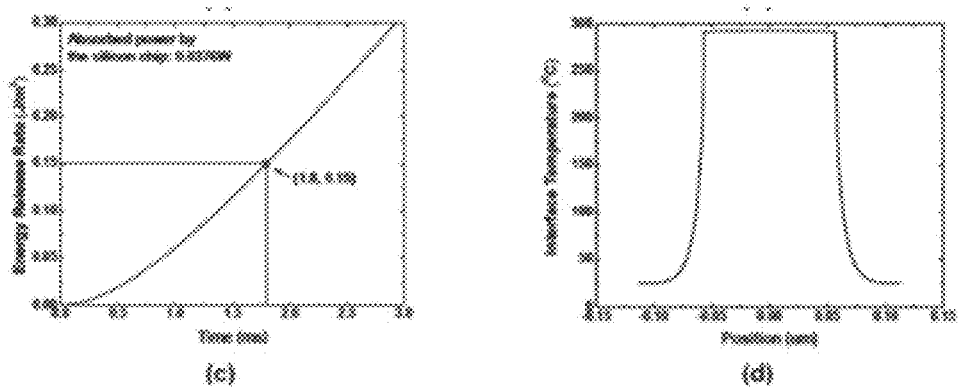

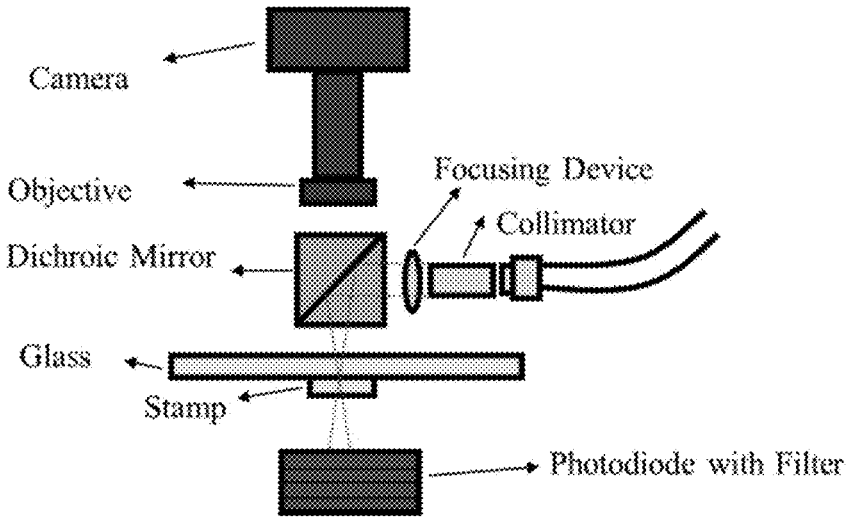
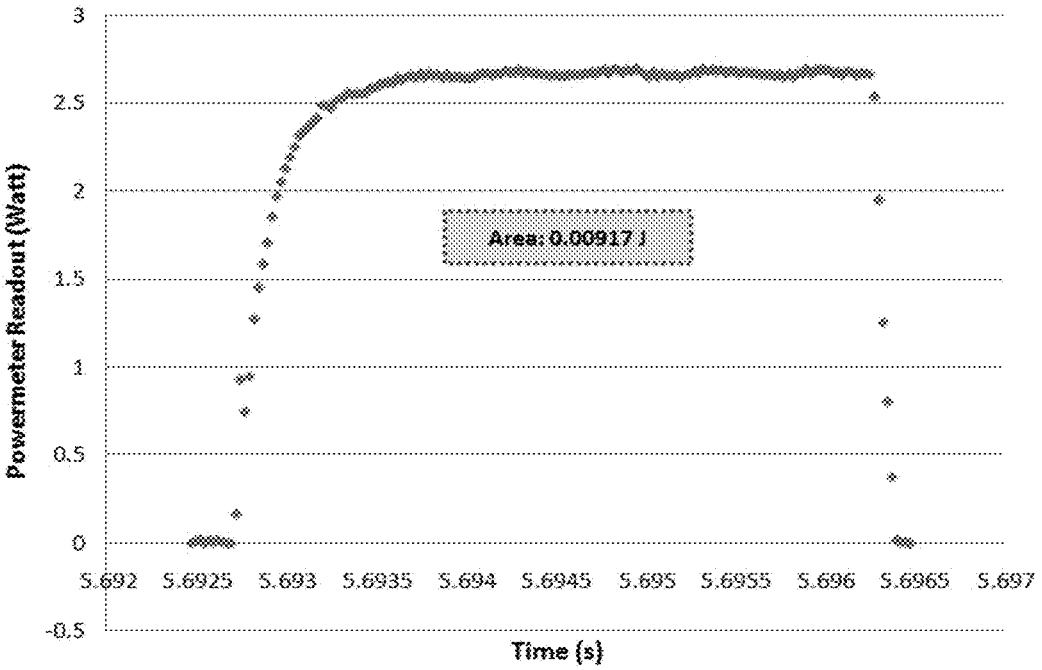
Figure 24(A)

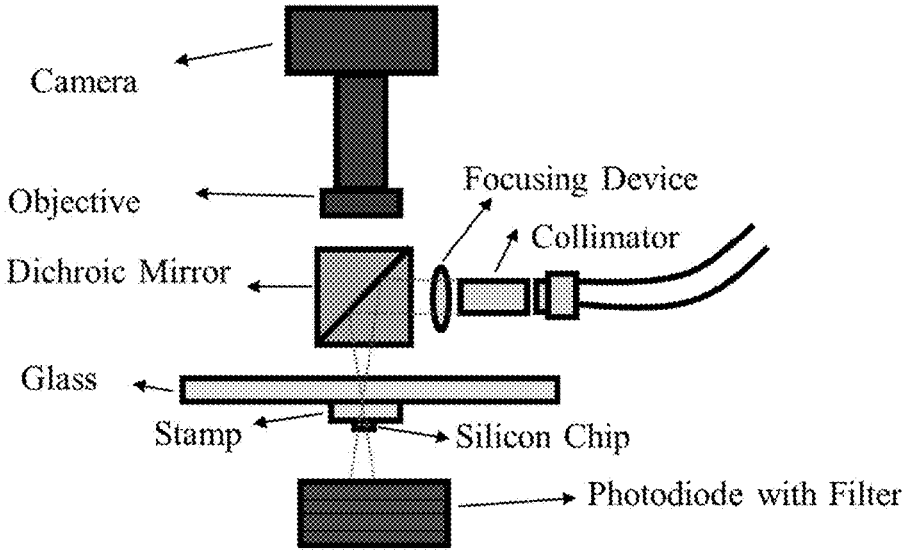
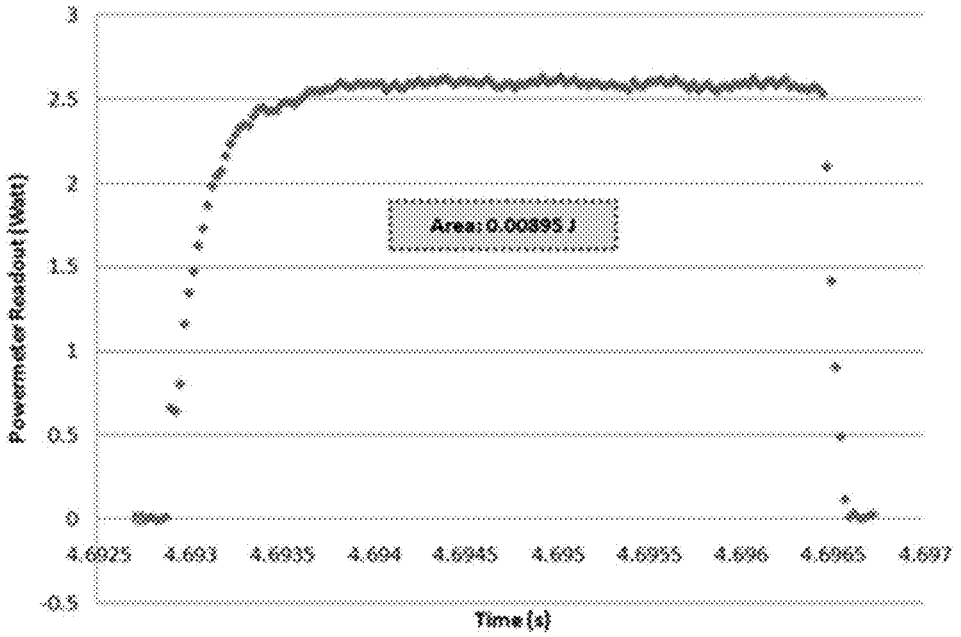
Figure 24(B)

A

B

A

B

C

NON-CONTACT TRANSFER PRINTING

CROSS-REFERENCE TO RELATED APPLICATIONS

This application claims the benefit of priority from U.S. Provisional Patent Application Nos. 61/507,784, filed Jul. 14, 2011, and 61/594,652, filed Feb. 3, 2012, each of which is hereby incorporated by reference in its entirety.

STATEMENT REGARDING FEDERALLY SPONSORED RESEARCH OR DEVELOPMENT

This invention was made with United States governmental support awarded by the Center for Nanoscale Chemical-Electrical-Mechanical System (NanoCEMMS), a Nanoscale Science and Engineering Center sponsored by the National Science Foundation under Award No. 0749028 (CMMI). The U.S. government has certain rights in the invention.

BACKGROUND OF THE INVENTION

An increasing number of technologies require integration of disparate classes of separately fabricated objects into spatially organized, functional systems. Examples of systems that rely critically on heterogeneous integration range from optoelectronic systems that integrate lasers, lenses and optical fibers with control electronics, to tools for neurological study that involve cells interfaced to arrays of inorganic sensors, to flexible circuits and actuators that combine inorganic device components with thin plastic substrates. The most significant challenges associated with realizing these types of systems derive from the disparate nature of the materials and the often vastly different techniques needed to process them into devices. As a result, all broadly useful integration strategies begin with independent fabrication of components followed by assembly onto a device substrate.

As one example of an integration strategy, Laser Direct-Write (LDW) processing techniques have been succinctly categorized by Arnold and Pique [1]. Some of the present methods fall within the LDW category referred to as Laser Direct-Write Addition (or LDW+) and, more specifically, Laser-Induced Forward Transfer (LIFT) or Laser-Driven Release. This type of a transfer process was first reported by Bohandy et al [2]. LIFT-type processes have been used, for example, to assemble or print fabricated microstructures, and Holmes and Saidam [3], calling the approach Laser-Driven Release, used it for batch assembly in microelectromechanical system (MEMS) fabrication.

Most LDW processes involve ablation of a sacrificial layer that holds an object to a transfer surface. During transfer, the sacrificial layer is vaporized to form a gas that expels the object from the transfer surface to a receiving substrate. However, these processes suffer from time- and material-related expenses resulting from the necessity of forming and then destroying the sacrificial layer. They also risk contamination of the final product due to the ubiquitous presence of the ablated sacrificial material.

A number of patent and non-patent documents describe methods and systems for transfer printing, including U.S. Pat. Pub. No. 2009/0217517; U.S. Pat. Nos. 7,998,528; 7,932,123; and 7,622,367; Holmes et al., "Sacrificial layer process with laser-driven release for batch assembly operations," *J. MEMS,* 7(4), 416-422, (1998); and Germain et al., "Electrodes for microfluidic devices produced by laser induced forward transfer," *Applied Surface Science,* 253, 8328-8333, (2007), each of which is hereby incorporated by reference to the extent not inconsistent herewith.

SUMMARY OF THE INVENTION

The present invention encompasses a non-contact approach for manipulation and heterogeneous integration that uses controlled release of an object from a transfer device, or stamp, to transfer print objects from one substrate to another. Upon actuation of a transfer device, a physical force, such as a pressure change, a thermal change, an electrostatic change, and/or a mechanical change, leads to release of ink disposed on the transfer surface. The physics of the delamination process that govern this non-contact transfer and methods of printing objects with a wide range of sizes and shapes onto a variety of substrates are described.

In contrast with prior art printing processes that build devices on a receiving substrate, the present invention provides a facile, non-contact transfer printing process that transfers objects, such as prefabricated micro- and/or nano-devices, from a growth/fabrication substrate to a functional receiving substrate that is incapable of supporting device growth and/or fabrication processes. Thus, the present invention may not only be used in place of existing printing processes to fabricated devices, it may also be used in conjunction with existing printing processes for downstream transfer of devices fabricated by existing printing processes onto unique substrates.

In one embodiment, the present invention exploits a mismatched thermo-mechanical response of the prefabricated device (ink) and a transfer surface (stamp) to a force incident on the ink-stamp interface to cause delamination of the ink from the stamp and its transfer to the target/receiving substrate. This process operates at lower temperatures than ablation processes, thus avoiding damage to the functional devices. More importantly, because the transfer does not substantially damage the stamp material, the same area of the stamp can be used multiple times, enabling a pick-print-repeat cycle. This non-contact "pick-and-place" technique provides an important combination of capabilities that is not offered by other assembly methods, such as those based on ablation techniques, wafer bonding, or directed self-assembly.

Besides providing the desired mismatch in thermo-mechanical response with commonly-used semiconductor materials, stamps of the present invention make it possible to directly and selectively pick-up micro- or nano-devices from growth or donor substrates by using well-developed techniques [4-8], such as that described in U.S. Pat. No. 7,622,367, which is hereby incorporated by reference in its entirety. These techniques overcome one of the major limitations of using LIFT-type printing processes for assembling devices, i.e., the transfer of the micro- or nano-devices from the growth/fabrication substrate to the stamp [9]. The present invention therefore combines the facile elegance of transfer-printing processes in taking prefabricated devices directly from their growth substrates to functional substrates with the flexibility of non-contact LIFT processes that are relatively independent of surface properties of the receiving substrate onto which the devices are transferred. The ability to transfer the prefabricated devices enables, for example, the embedding of high-performance electronic and optoelectronic components into polymeric substrates to realize new capabilities in emerging areas such as flexible and large-area electronics, displays and photovoltaics.

The methods presented herein allow manipulation of arrays of objects based on mechanically or thermo-mechanically controllable release from a stamp in a massively parallel and deterministic manner. The mechanics suggest paths for optimizing the material properties of the stamps in ways that have not been explored in soft lithography or related areas. Even with existing materials, the printing procedure provides robust capabilities for generating microstructured hybrid materials systems and device arrays with applications in optoelectronics, photonics, non-planar fabrication and biotechnology. The non-contact, stamp-based methods of the present invention are invaluable tools for printing microelectromechanical (MEM) and nanoelectromechanical (NEM) devices.

In an aspect, a method of transferring ink from a donor substrate to a receiving substrate comprises: providing a transfer device having a transfer surface; providing the donor substrate having a donor surface, the donor surface having ink thereon; contacting at least a portion of the transfer surface with at least a portion of the ink; separating the transfer surface from the donor surface, wherein at least a portion of the ink is transferred from the donor surface to the transfer surface; positioning the transfer surface having the ink disposed thereon into alignment with a receiving surface of the receiving substrate, wherein a gap remains between the ink disposed on the transfer surface and the receiving surface; and actuating the transfer device, the ink, or both of the transfer device and the ink by generating a force that releases at least a portion of the ink from the transfer surface while maintaining at least a portion of said gap, thereby transferring at least a portion of the ink to the receiving surface.

In a method of the invention, for example, the transfer device does not make physical contact with the receiving surface during the entire process resulting in the transfer of the ink to the receiving surface. In a method of the invention, for example, the ink does not make physical contact with the receiving surface while it is disposed on the transfer surface of the transfer device. In a method of the invention, for example, the ink is transferred to the receiving surface by a process not including contact printing, such as dry transfer contact printing. In an embodiment, the gap is at least partially maintained during the entire process. The invention includes methods wherein at least 50% of the gap is maintained during the entire process, and optionally for some applications at least 90% of the gap is maintained during the entire process.

The force applied to the transfer surface generates a mechanical or thermomechanical response. For example, in one embodiment, the step of actuating comprises mechanically actuating, optically actuating, electrically actuating, magnetically actuating, thermally actuating, or a combination thereof. In one embodiment, the step of actuating comprises mechanically stressing an interface between the transfer surface and the ink so as to cause delamination, thereby resulting in release of the ink. In one embodiment, the step of actuating the transfer device uses a laser, a piezoelectric actuator, a gas source, a vacuum source, an electromagnetic source, an electrostatic source, an electronic source, a heat source, or a combination thereof.

When the step of actuating uses a gas source, the gas may be selected from the group consisting of nitrogen, argon, krypton, xenon, and combinations thereof. In one embodiment, the gas source directs a flow or burst of gas onto the transfer device or the ink disposed on the transfer surface of the transfer device, thereby mechanically actuating the transfer device, the ink or both. In one embodiment, the gas source directs the flow or burst of gas through one or more channels or reservoirs in the transfer device onto the ink, thereby generating the force that releases at least a portion of the ink from the transfer surface. The gas source produces gas having a pressure selected from the range of 5 psi to 100 psi, which is, in one embodiment, produced for a period selected from the range of 1 millisecond to 10 milliseconds.

When the step of actuating uses a vacuum source, the vacuum source is provided in fluid communication with the transfer device, the ink or both such that the vacuum source produces a pressure on the transfer device, the ink or both, thereby generating the force that releases at least a portion of the ink from the transfer surface. The vacuum source produces a pressure selected from the range of $10^{-3}$ torr to $10^{-5}$ torr.

When the step of actuating uses an electromagnetic source, the electromagnetic source is provided in optical communication with the transfer device, the ink or both and provides electromagnetic radiation onto the transfer device, the ink disposed on the transfer device or both. In one embodiment, the electromagnetic source provides the electromagnetic radiation onto the transfer surface of the transfer device, the ink disposed on the transfer surface or both. The electromagnetic source may produce radiation in the radio, microwave, infrared, visible, or ultraviolet region of the electromagnetic spectrum having a wavelength selected from the range of 300 μm to 5 μm and/or a power selected from the range of 10 W to 100 W for printing inks with lateral dimensions in the range of 100 microns to 600 microns. For example, the electromagnetic radiation may be characterized by a pulse width selected over the range of 100 μs and 10 milliseconds and/or a focused beam spot having an area selected from the range of 150 $\mu m^2$ to 1 $mm^2$. In one embodiment, the electromagnetic radiation delivers less than 0.5 mJ of energy to the ink. In one embodiment, the electromagnetic radiation is spatially translated on the transfer surface of the transfer device, for example, at a rate of at least 50 mm/sec, or a rate of at least 100 mm/sec, or a rate selected from the range of 50 mm/sec to 500 mm/sec, or a range of 50 mm/sec to 250 mm/sec, or a range of 50 mm/sec to 150 mm/sec. In an embodiment, the electromagnetic radiation has a wavelength in the near infrared region of the electromagnetic spectrum selected from the range of 800 nm to 1000 nm. In an embodiment, the electromagnetic radiation is absorbed by the ink disposed on the transfer surface of the transfer device. In one embodiment, a laser delivering the electromagnetic radiation may be operated at an electric potential between 0.5 volts and 2.5 volts and/or a current selected from a range of 10 amperes to 25 amperes and/or a power less than or equal to 30 watts.

When the step of actuating uses an electrostatic source, the electrostatic source generates an applied electric field on the transfer surface, the ink disposed on the transfer surface, or both.

When the step of actuating uses a heat source, the heat source heats the transfer device, the ink, or both of the transfer device and the ink, thereby thermally actuating the transfer device, the ink, or both of the transfer device and the ink. The heat source may produce a temperature of the transfer surface selected from the range of 275° C. to 325° C. and/or may produce a temperature gradient in the transfer device selected from the range of $10^{4\circ}$ C. $cm^{-1}$ to $10^{5\circ}$ C. $cm^{-1}$.

When the step of actuating uses a piezoelectric actuator, the piezoelectric actuator physically contacts the transfer surface of the transfer device, thereby electrically actuating the ink.

In general, the step of actuating induces a thermomechanical force at an interface between the ink and the transfer surface resulting in delamination of the ink from the transfer surface, thereby resulting in release of the ink from the transfer surface. For example, the magnitude and spatial distribution of the force may be selected so as to generate a separation energy between ink and the transfer surface equal to or greater than 1 J/meter$^2$. Typically, delamination begins at a corner of the ink and propagates toward a center of the ink, thereby resulting in release of the ink from the transfer surface. Delamination results, for example, when the transfer device and the ink have a ratio of coefficients of thermal expansion selected from the range of 500 to 2, or 100 to 2, or 50 to 2, or 25 to 2, or 10 to 2 and/or when the transfer device and the ink have a ratio of Young's moduli selected from the range of 10 and 100. For example, the ink may have a coefficient of thermal expansion selected from the range of 1 ppm ° C.$^{-1}$ to 10 ppm ° C.$^{-1}$ and the transfer device may have a coefficient of thermal expansion selected from the range of 100 ppm ° C.$^{-1}$ to 500 ppm ° C.$^{-1}$ and/or the ink may have a Young's modulus selected from the range of 10 GPa and 500 GPa and the transfer device may comprise at least one elastomer layer having a Young's modulus selected over the range of 1 MPa and 10 GPa. In some embodiments, the force applied to the transfer surface is a non-ablative force.

In one embodiment, the gap is characterized by a distance between the ink disposed on the transfer surface and the receiving surface equal to or greater than 1 micron, or equal to or greater than 5 microns, or greater than or equal to 10 microns, or greater than or equal to 20 microns, or greater than or equal to 30 microns, or greater than or equal to 50 microns. In theory, the gap is characterized by a distance between the ink disposed on the transfer surface and the receiving surface that is infinite. In practice, the accuracy of the process is improved when the gap is equal to or less than 50 microns, or equal to or less than 30 microns, or equal to or less than 20 microns, or equal to or less than 10 microns, or equal to or less than 5 microns, or equal to or less than 1 micron. In one embodiment, the gap is characterized by a distance between the ink disposed on the transfer surface and the receiving surface selected from the range of 1 micron to 50 microns, or selected from the range of 1 micron to 30 microns, or selected from the range of 1 micron to 20 microns, or selected from the range of 1 micron to 10 microns, or selected from the range of 1 micron to 5 microns.

The laser may be spatially translated to release ink having one or more dimensions significantly larger than the focused beam spot diameter. For example, the ink may have a length selected over the range of 100 nanometers to 1000 microns, a width selected over the range of 100 nanometers to 1000 microns and a thickness selected over the range of 1 nanometer to 1000 microns.

In one embodiment, a contact surface of the ink is provided in physical contact with the transfer device, wherein the contact surface has a surface area selected over the range of $10^6$ nm$^2$ to 1 mm$^2$. The ink may, for example, be a material selected from the group consisting of a semiconductor, a metal, a dielectric, a ceramic, a polymer, a glass, a biological material or any combination of these. In one embodiment, the ink is a micro-sized or nano-sized prefabricated device or component thereof. The prefabricated device may be a printable semiconductor element, a single crystalline semiconductor structure, or a single crystalline semiconductor device. For example, the prefabricated device may have a shape selected from the group consisting of a ribbon, a disc, a platelet, a block, a column, a cylinder, and any combination thereof. The prefabricated device may comprise an electronic, optical or electro-optic device or a component of an electronic, optical or electro-optic device selected from the group consisting of: a P-N junction, a thin film transistor, a single junction solar cell, a multi-junction solar cell, a photodiode, a light emitting diode, a laser, a CMOS device, a MOSFET device, a MESFET device, a HEMT device, a photovoltaic device, a sensor, a memory device, a microelectromechanical device, a nanoelectromechanical device, a complementary logic circuit, and a wire.

In some methods, a plurality of prefabricated devices may be provided on the receiving substrate. Substantially all of the prefabricated devices may be transferred from the donor surface to the transfer surface simultaneously and substantially all of the prefabricated devices in contact with the transfer surface may be transferred to the receiving surface simultaneously or one at a time (individually).

In an aspect, at least a portion of the steps of the method of transferring ink from a donor substrate to a receiving substrate may be repeated so as to generate multi-layered ink structures on the receiving surface. For example, multi-layered ink structures may be three-dimensional and at least some of the ink may be deposited onto previously deposited ink.

In some methods of the present invention, the force applied to the transfer device, the ink, or both of the transfer device and the ink does not substantially degrade the transfer device. For example, in one embodiment, the steps may be repeated using a single transfer device between 20-25 times before substantial degradation of the transfer device is detectable.

In one embodiment, the transfer device comprises at least one elastomer layer having a thickness selected over the range of 1 micron to 1000 microns and/or a Young's Modulus selected over the range of 1 MPa to 10 GPa. The transfer device may, for example, comprise an elastomeric stamp, elastomeric mold, or elastomeric mask. In one embodiment, the transfer device comprises at least one elastomer layer operably connected to one or more polymer, glass or metal layers. In some embodiments, the transfer device is at least partially transparent to electromagnetic radiation having wavelengths in ultraviolet, visible or infrared regions of the electromagnetic spectrum. In one embodiment, the transfer device comprises a material selected from the group consisting of glass and silica. In one embodiment, the transfer device is an elastomeric transfer device. For example, the transfer device may comprise polydimethylsiloxane.

The transfer device may be substantially planar or microstructured or nanostructured. A microstructured or nanostructured transfer device comprises at least one relief feature having a surface for contacting ink. The relief feature extends, for example, at least 5 micrometers, or at least 10 micrometers, from the transfer surface. In some embodiments, the relief feature has a cross-sectional area perpendicular to a longitudinal axis of the relief feature, and the cross-sectional area has a major dimension that is less than or equal to 1000 micrometers. The transfer device may comprise a plurality of relief features forming an array and having surfaces for contacting ink. Each relief feature in the array is separated from any other relief feature in the array by a distance of 3 micrometers to 100 millimeters, or 5 micrometers to 1 millimeter, or 10 micrometers to 50 micrometers.

In one embodiment, a layer of absorbing material is encapsulated within the relief feature. The layer may be positioned between 1 micrometer and 100 micrometers, or between 1 micrometer and 10 micrometers, from a distal end of the relief feature and substantially equidistant from the surface of the relief feature. The absorbing material may be selected from the group consisting of silicon, graphite, carbon black, and any metal. Generally, surface preparations (such as nanopatterning) are used to reduce reflection losses and the absorbing material and the incident radiation should be matched to achieve the highest absorption of the incident radiation.

In one embodiment, the receiving substrate is a material selected from the group consisting of: a polymer, a semiconductor wafer, a ceramic material, a glass, a metal, paper, a dielectric material, a liquid, a biological cell, a hydrogel and any combination of these. The receiving surface may be planar, rough, charged, neutral, non-planar, or contoured because the placement accuracy of the transfer method is independent of the shape, composition and surface contour of the receiving substrate.

In some methods of the present invention, the ink adheres directly to the transfer surface. In an alternate embodiment, an absorbing material is provided between the ink and the transfer surface. The absorbing material may be applied to the ink or the transfer surface prior to the step of contacting at least a portion of the transfer surface with at least a portion of the ink, and the absorbing material may be removed after the step of applying a force to the transfer surface. In an embodiment, the absorbing material is a thermal adhesive or a photoactivated adhesive. In an embodiment, the absorbing material has a coefficient of thermal expansion selected from the range of 300 ppm ° $C.^{-1}$ to 1 ppm ° $C.^{-1}$, a Young's modulus selected from the range of 100 MPa to 500 GPa, a thickness selected from the range of 2 microns to 10 microns, and/or is selected from the group consisting of materials that absorb at the wavelength of irradiation, such as silicon, graphite, carbon black, metals with nanostructured surfaces, and combinations thereof.

In some methods, the steps of: contacting at least a portion of the transfer surface with at least a portion of the ink, separating the transfer surface from the donor surface, positioning the transfer surface, or any combination of these steps is carried out via an actuator operationally connected to the transfer device and/or by an actuator operationally connected to one or more xyz-positionable stages supporting donor and/or receiving substrates.

In one embodiment, the step of positioning the transfer surface having the ink disposed thereon into alignment with the receiving surface provides the transfer surface in proximity to selected regions of the receiving surface and/or provides registration between the ink and selected regions of the receiving surface. The selected regions of the receiving surface may correspond to devices or device components prepositioned on the receiving surface of the receiving substrate. Generally, the ink is transferred to the receiving surface with a placement accuracy greater than or equal to 25 microns over a receiving surface area equal to 5 $cm^2$ and the proximity is to within 2-5 μm or less.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

BRIEF DESCRIPTION OF THE DRAWINGS

FIGS. 1(A), 1(B), 1(C), 1(D): Schematic of the laser transfer printing steps: FIG. 1(A), 1—the PDMS stamp is aligned with the donor substrate to pick up the ink; FIG. 1(B), 2—the ink is transferred to the stamp; FIG. 1(C), 3—the stamp is aligned to a receiving substrate and a laser pulse is used to heat up the ink-stamp interface; and FIG. 1(D), 4—the ink is transferred to the receiving substrate and the stamp is withdrawn for the next printing cycle.

FIG. 2: A schematic depiction and photograph of the laser-driven non-contact transfer printing (LNTP) print head. The laser beam is brought into the print head by an optical fiber, bent and focused on the ink-stamp interface. A dichroic mirror allows for monitoring of the process with a high-speed camera positioned above the stamp.

FIG. 3(A) 100×100×3 micron silicon squares printed between metallic traces on a silicon wafer, FIG. 3(B) 3-D pyramid printed with the same silicon squares, FIG. 3(C) A silicon square printed on a silicon cantilever, and FIG. 3(D) 100×100×0.32 micron ultrathin Si square printed onto a structured substrate.

FIG. 4(A) InGaN-based μ-LED printed onto a structured silicon substrate, FIG. 4(B) Schematic stacks of the InGaN-based μ-LED, FIG. 4(C) Functioning μ-LED printed onto a CVD-grown polycrystalline diamond on silicon substrate.

FIG. 5: Frames from a high-speed film showing (a) the delamination process that starts at the corners (frame 2) and progresses towards the center resulting in the chip leaving the stamp and (b) a partial delamination event in which the delamination front begins moving towards the center from the corners before reversing directions. The chip remains adhered to the stamp.

FIGS. 9(A), 9(B), 9(C), 9(D): FIG. 9(A) Finite element model of the transfer printing system, FIG. 9(B) Temperature distribution in the post and attached chip at 1.8 milliseconds, FIG. 9(C) Energy release rate distribution with time, and FIG. 9(D) Temperature gradient through the stamp-ink interfaces.

FIG. 15(A) Geometry of the initial setup. FIG. 15(B)

Resulting forces and moments on the system as a result of the thermal mismatch strains. FIG. 15(C) To relieve strain energy, the system deforms in bending. The PDMS stamp is more compliant and as a result its curvature is more pronounced. FIG. 15(D) Deformation due to bending in the system produces delamination of the printing chip from the stamp. The delamination front at the interface moves from the corners of the chip towards its center.

FIG. 20(A) Optical micrograph of silicon squares printed on a silicon substrate with gold traces; FIG. 20(B) A 3-D pyramidal structure built of silicon squares; and FIG. 20(C) A bridge structure built by printing a silicon plate on two bars patterned on a silicon substrate. (Scale: Silicon squares in micrographs have sides of 100 μm).

FIGS. 24(A), 24(B): Schematic of laser power measurement set up and a typical measurement for a pulse FIG. 24(A) without the ink and FIG. 24(B) with the ink on the stamp.

FIG. 28(A) Electromagnetic radiation passes through a substantially transparent transfer device and is absorbed by ink adhered to the transfer surface of transfer device and FIG. 28(B) A transfer device contains embedded absorbing material that absorbs electromagnetic radiation to prevent excessive heating of the ink.

FIG. 29(A) Transmission through a substantially transparent transfer device, FIG. 29(B) Transmission through a substantially transparent receiving substrate, and FIG. 29(C) Illumination of the interface between the transfer device and ink from the side.

DETAILED DESCRIPTION OF THE INVENTION

Figure 3A:
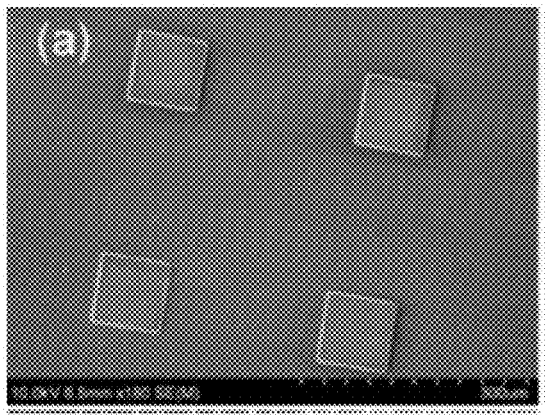
FIGS. 3(A), 3(B), 3(C), 3(D): Micrographs of examples of printing using the LNTP process.
Figure 3B:
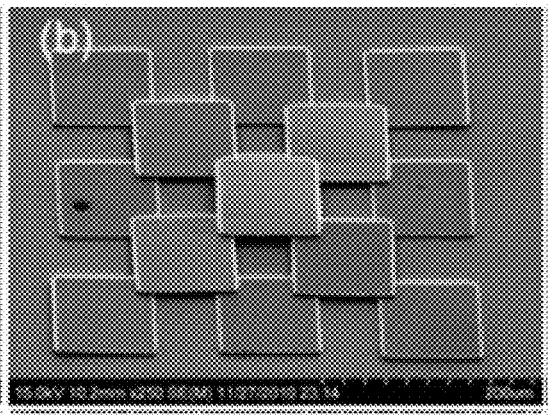
Figure 3D:
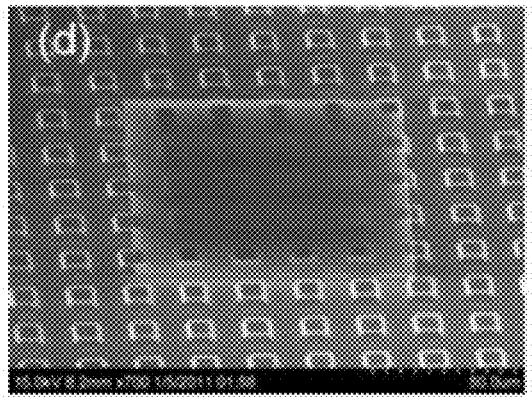
Figure 3C:
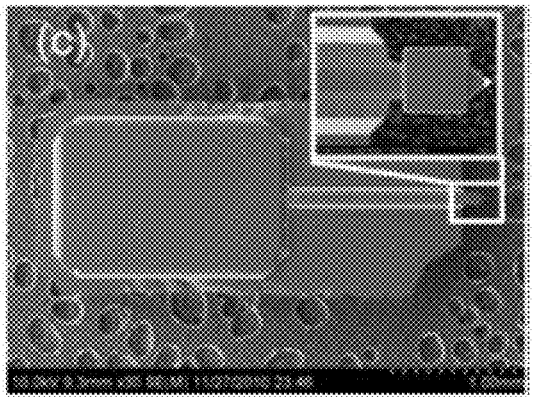

In general, the terms and phrases used herein have their art-recognized meaning, which can be found by reference to standard texts, journal references and contexts known to those skilled in the art. The following definitions are provided to clarify their specific use in the context of the invention.

"Delamination" refers to separation at an interface between substantially parallel, contacting layers when energy at the interface becomes greater than the energy of adhesion holding the layers in contact with one another.

"Ink" refers to a discrete unit of material capable of being transferred from a donor substrate to a receiving substrate. Ink may be solid, liquid or a combination thereof. "Ink" may, for example, be an atomic or molecular precursor to a device component, a device component, or a prefabricated device.

A "device" is a combination of components operably connected to produce one or more desired functions. A "prefabricated device" is a device that is fabricated on a donor substrate, but destined for a receiving substrate that is less capable than the donor substrate of supporting the fabrication process or incapable of supporting the fabrication process.

A "component" is used broadly to refer to an individual part of a device. An "interconnect" is one example of a component, and refers to an electrically conducting structure capable of establishing an electrical connection with another component or between components. Other components include, but are not limited to, thin film transistors (TFTs), transistors, electrodes, integrated circuits, circuit elements, control elements, microprocessors, transducers, islands, bridges and combinations thereof.

"Actuating" broadly refers to a process wherein a device, device component, structure, or material is acted upon, for example, so as to cause a change in one or more physical, chemical, optical or electronic properties. In an embodiment, for example, actuating comprises one or more of mechanically actuating, optically actuating, electrically actuating, electrostatically actuating, magnetically actuating, and thermally actuating. In some methods and systems of the invention, actuating involves a process in which energy is provided to, or taken away from, a device, device component, structure, or material, such as a transfer device and/or ink. In some embodiments, for example, the energy provided, or taken away, is thermal energy, mechanical energy, optical energy, electronic energy, electrostatic energy or any combination of these. In some methods and systems of the invention, actuating involves activating a transfer device and/or ink so as to generate a force that releases at least a portion of the ink from the transfer surface. In some methods and systems of the invention, actuating involves exposing a transfer device and/or ink to electromagnetic radiation, such as laser radiation, so as to generate a force that releases at least a portion of the ink from a transfer surface of the transfer device. In some methods and systems of the invention, actuating involves exposing a transfer device and/or ink to thermal energy, such as heat, so as to generate a force that releases at least a portion of the ink from a transfer surface of the transfer device. In some methods and systems of the invention, actuating involves exposing a transfer device and/or ink to an electromagnetic field, so as to generate a force that releases at least a portion of the ink from a transfer surface of the transfer device. In some methods and systems of the invention, actuating involves exposing a transfer device and/or ink to a magnetic field, so as to generate a force that releases at least a portion of the ink from a transfer surface of the transfer device. In some methods and systems of the invention, actuating involves physically contacting and/or moving a transfer device and/or ink so as to generate a force that releases at least a portion of the ink from a transfer surface of the transfer device, for example, using a piezoelectric actuator, source of a fluid (e.g., gas source) or a vacuum source. In an embodiment, for example, actuating involves a process wherein a transfer device or ink disposed on the surface of the transfer device does not physically contact the receiving surface of a substrate.

"Alignment" is used herein to refer to the relative arrangement or position of surfaces or objects. For example, the transfer surface of the transfer device and receiving surface of the receiving substrate are in alignment when a gap between the surfaces is a consistent, predetermined separation distance along a vertical axis perpendicular to the planes of the surfaces.

"Registration" is used in accordance with its meaning in the art of microfabrication. Registration refers to the precise positioning of ink, components and/or devices on a selected region of a substrate or relative to ink, components and/or devices that preexist on a substrate. For example, alignment of the transfer surface and receiving surface brings ink disposed on the transfer surface into registration with selected regions of the receiving surface. In some embodiments, the selected regions correspond to ink, devices or device components prepositioned on the receiving surface of the receiving substrate.

"Semiconductor" refers to any material that is an insulator at a very low temperature, but which has an appreciable electrical conductivity at a temperature of about 300 Kelvin. In the present description, use of the term semiconductor is intended to be consistent with use of this term in the art of microelectronics and electronic devices. Useful semiconductors include those comprising elemental semiconductors, such as silicon, germanium and diamond, and compound semiconductors, such as group IV compound semiconductors such as SiC and SiGe, group III-V semiconductors such as AlSb, AlAs, AlN, AlP, BN, BP, BAs, GaSb, GaAs, GaN, GaP, InSb, InAs, InN, and InP, group III-V ternary semiconductors alloys such as $Al_xGa_{1-x}As$, group II-VI semiconductors such as CsSe, CdS, CdTe, ZnO, ZnSe, ZnS, and ZnTe, group I-VII semiconductors such as CuCl, group IV-VI semiconductors such as PbS, PbTe, and SnS, layer semiconductors such as $PbI_2$, $MoS_2$, and GaSe, oxide semiconductors such as CuO and $Cu_2O$. The term semiconductor includes intrinsic semiconductors and extrinsic semiconductors that are doped with one or more selected materials, including semiconductors having p-type doping materials and n-type doping materials, to provide beneficial electronic properties useful for a given application or device. The term semiconductor includes composite materials comprising a mixture of semiconductors and/or dopants. Specific semiconductor materials useful for some embodiments include, but are not limited to, Si, Ge, Se, diamond, fullerenes, SiC, SiGe, SiO, $SiO_2$, SiN, AlSb, AlAs, AlIn, AlN, AlP, AlS, BN, BP, BAs, $As_2S_3$, GaSb, GaAs, GaN, GaP, GaSe, InSb, InAs, InN, InP, CsSe, CdS, CdSe, CdTe, $Cd_3P_2$, $Cd_3As_2$, $Cd_3Sb_2$, ZnO, ZnSe, ZnS, ZnTe, $Zn_3P_2$, $Zn_3As_2$, $Zn_3Sb_2$, $ZnSiP_2$, CuCl, PbS, PbSe, PbTe, FeO, $FeS_2$, NiO, EuO, EuS, PtSi, TlBr, $CrBr_3$, SnS, SnTe, $PbI_2$, $MoS_2$, GaSe, CuO, $Cu_2O$, HgS, HgSe, HgTe, $HgI_2$, MgS, MgSe, MgTe, CaS, CaSe, SrS, SrTe, BaS, BaSe, BaTe, $SnO_2$, TiO, $TiO_2$, $Bi_2S_3$, $Bi_2O_3$, $Bi_2Te_3$, $BiI_4$, $UO_2$, $UO_3$, $AgGaS_2$, PbMnTe, $BaTiO_3$, $SrTiO_3$, $LiNbO_3$, $La_2CuO_4$, $La_{0.7}Ca_{0.3}MnO_3$, CdZnTe, CdMnTe, $CuInSe_2$, copper indium gallium selenide (CIGS), HgCdTe, HgZnTe, HgZnSe, PbSnTe, $Tl_2SnTe_5$, $Tl_2GeTe_5$, AlGaAs, AlGaN, AlGaP, AlInAs, AlInSb, AlInP, AlInAsP, AlGaAsN, GaAsP, GaAsN, GaMnAs, GaAsSbN, GaInAs, GaInP, AlGaAsSb, AlGaAsP, AlGaInP, GaInAsP, InGaAs, InGaP, InGaN, InAsSb, InGaSb, InMnAs, InGaAsP, InGaAsN, InAlAsN, GaInNAsSb, GaInAsSbP, and any combination of these. Porous silicon semiconductor materials are useful for aspects described herein. Impurities of semiconductor materials are atoms, elements, ions and/or molecules other than the semiconductor material(s) themselves or any dopants provided to the semiconductor material. Impurities are undesirable materials present in semiconductor materials which may negatively impact the electronic properties of semiconductor materials, and include but are not limited to oxygen, carbon, and metals including heavy metals. Heavy metal impurities include, but are not limited to, the group of elements between copper and lead on the periodic table, calcium, sodium, and all ions, compounds and/or complexes thereof.

A "semiconductor component" broadly refers to any semiconductor material, composition or structure, and expressly includes high quality single crystalline and polycrystalline semiconductors, semiconductor materials fabricated via high temperature processing, doped semiconductor materials, inorganic semiconductors, and composite semiconductor materials.

"Substrate" refers to a material, layer or other structure having a surface, such as a receiving surface, that is capable of supporting one or more components or electronic devices. A component that is "bonded" to the substrate refers to a component that is in physical contact with the substrate and unable to substantially move relative to the substrate surface to which it is bonded. Unbonded components or portions of a component, in contrast, are capable of substantial movement relative to the substrate.

"Functional layer" refers to a layer that imparts some functionality to a device. For example, a functional layer may contain semiconductor components. Alternatively, the functional layer may comprise multiple layers, such as multiple semiconductor layers separated by support layers. The functional layer may comprise a plurality of patterned elements, such as interconnects running between electrodes or islands.

"Structural layer" refers to a layer that imparts structural functionality, for example by supporting and/or encapsulating device components.

"Polymer" refers to a macromolecule composed of repeating structural units connected by covalent chemical bonds or the polymerization product of one or more monomers, often characterized by a high molecular weight. The term polymer includes homopolymers, or polymers consisting essentially of a single repeating monomer subunit. The term polymer also includes copolymers, or polymers consisting essentially of two or more monomer subunits, such as random, block, alternating, segmented, grafted, tapered and other copolymers. Useful polymers include organic polymers or inorganic polymers that may be in amorphous, semi-amorphous, crystalline or partially crystalline states. Crosslinked polymers having linked monomer chains are particularly useful for some applications. Polymers useable in the methods, devices and components described herein include, but are not limited to, plastics, elastomers, thermoplastic elastomers, elastoplastics, thermoplastics and acrylates. Exemplary polymers include, but are not limited to, acetal polymers, biodegradable polymers, cellulosic polymers, fluoropolymers, nylons, polyacrylonitrile polymers, polyamide-imide polymers, polyimides, polyarylates, polybenzimidazole, polybutylene, polycarbonate, polyesters, polyetherimide, polyethylene, polyethylene copolymers and modified polyethylenes, polyketones, poly(methyl methacrylate), polymethylpentene, polyphenylene oxides and polyphenylene sulfides, polyphthalamide, polypropylene, polyurethanes, styrenic resins, sulfone-based resins, vinyl-based resins, rubber (including natural rubber, styrene-butadiene, polybutadiene, neoprene, ethylene-propylene, butyl, nitrile, silicones), acrylic, nylon, polycarbonate, polyester, polyethylene, polypropylene, polystyrene, polyvinyl chloride, polyolefin or any combinations of these.

"Elastomeric stamp" and "elastomeric transfer device" are used interchangeably and refer to an elastomeric material having a surface that can receive as well as transfer a material. Exemplary elastomeric transfer devices include stamps, molds and masks. The transfer device affects and/or facilitates material transfer from a donor material to a receiver material. The methods of the present invention do not "substantially degrade" the elastomeric transfer device. As used herein, "substantial degradation" refers to chemical/physical decomposition or material removal occurring within at least 50 nm or within at least 100 nm of the transfer surface of the elastomeric transfer device.

"Elastomer" refers to a polymeric material which can be stretched or deformed and returned to its original shape without substantial permanent deformation. Elastomers commonly undergo substantially elastic deformations. Useful elastomers include those comprising polymers, copolymers, composite materials or mixtures of polymers and copolymers. Elastomeric layer refers to a layer comprising at least one elastomer. Elastomeric layers may also include dopants and other non-elastomeric materials. Useful elastomers include, but are not limited to, thermoplastic elastomers, styrenic materials, olefinic materials, polyolefin, polyurethane thermoplastic elastomers, polyamides, synthetic rubbers, PDMS, polybutadiene, polyisobutylene, poly(styrene-butadiene-styrene), polyurethanes, polychloroprene and silicones. In some embodiments, an elastomeric stamp comprises an elastomer. Exemplary elastomers include, but are not limited to silicon containing polymers such as polysiloxanes including poly(dimethyl siloxane) (i.e. PDMS and h-PDMS), poly(methyl siloxane), partially alkylated poly(methyl siloxane), poly(alkyl methyl siloxane) and poly (phenyl methyl siloxane), silicon modified elastomers, thermoplastic elastomers, styrenic materials, olefinic materials, polyolefin, polyurethane thermoplastic elastomers, polyamides, synthetic rubbers, polyisobutylene, poly(styrene-butadiene-styrene), polyurethanes, polychloroprene and silicones. In an embodiment, a polymer is an elastomer.

"Conformable" refers to a device, material or substrate which has a bending stiffness that is sufficiently low to allow the device, material or substrate to adopt any desired contour profile, for example a contour profile allowing for conformal contact with a surface having a pattern of relief features.

"Conformal contact" refers to contact established between two or more surfaces. In one aspect, conformal contact involves a macroscopic adaptation of one or more surfaces (e.g., contact surfaces) to the overall shape of another surface. In another aspect, conformal contact involves a microscopic adaptation of one or more surfaces (e.g., contact surfaces) to another surface resulting in an intimate contact substantially free of voids. In an embodiment, conformal contact involves adaptation of an ink surface(s) to a receiving surface(s) such that intimate contact is achieved, for example, wherein less than 20% of the surface area of an ink surface of the device does not physically contact the receiving surface, or optionally less than 10% of an ink surface of the device does not physically contact the receiving surface, or optionally less than 5% of an ink surface of the device does not physically contact the receiving surface.

"Young's modulus" is a mechanical property of a material, device or layer which refers to the ratio of stress to strain for a given substance. Young's modulus may be provided by the expression:

$$E = \frac{(\text{stress})}{(\text{strain})} = \left(\frac{L_0}{\Delta L}\right)\left(\frac{F}{A}\right), \tag{I}$$

where E is Young's modulus, $L_0$ is the equilibrium length, $\Delta L$ is the length change under the applied stress, F is the force applied, and A is the area over which the force is applied. Young's modulus may also be expressed in terms of Lame constants via the equation:

$$E = \frac{\mu(3\lambda + 2\mu)}{\lambda + \mu}, \tag{II}$$

where $\lambda$ and $\mu$ are Lame constants. High Young's modulus (or "high modulus") and low Young's modulus (or "low modulus") are relative descriptors of the magnitude of Young's modulus in a given material, layer or device. In some embodiments, a high Young's modulus is larger than a low Young's modulus, preferably about 10 times larger for some applications, more preferably about 100 times larger for other applications, and even more preferably about 1000 times larger for yet other applications. In an embodiment, a low modulus layer has a Young's modulus less than 100 MPa, optionally less than 10 MPa, and optionally a Young's modulus selected from the range of 0.1 MPa to 50 MPa. In an embodiment, a high modulus layer has a Young's modulus greater than 100 MPa, optionally greater than 10 GPa, and optionally a Young's modulus selected from the range of 1 GPa to 100 GPa.

"Inhomogeneous Young's modulus" refers to a material having a Young's modulus that spatially varies (e.g., changes with surface location). A material having an inhomogeneous Young's modulus may optionally be described in terms of a "bulk" or "average" Young's modulus for the entire material.

"Low modulus" refers to materials having a Young's modulus less than or equal to 10 MPa, less than or equal to 5 MPa or less than or equal to 1 MPa.

"Bending stiffness" is a mechanical property of a material, device or layer describing the resistance of the material, device or layer to an applied bending moment. Generally, bending stiffness is defined as the product of the modulus and area moment of inertia of the material, device or layer. A material having an inhomogeneous bending stiffness may optionally be described in terms of a "bulk" or "average" bending stiffness for the entire layer of material.

Thermomechanically driven, non-contact transfer printing devices and methods will now be described with reference to the figures and the following non-limiting examples.

Figure 26:
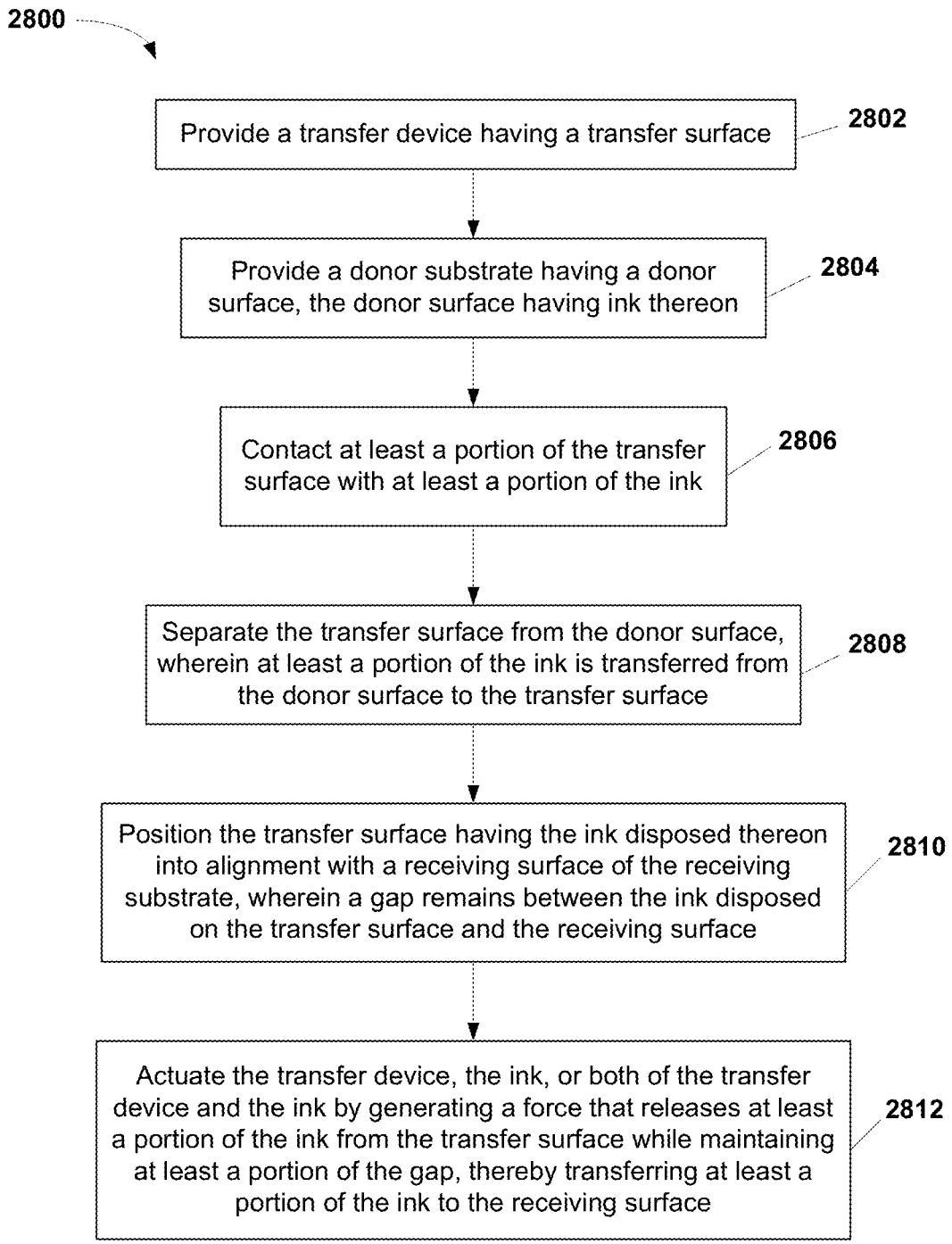
FIG. 26: A flowchart showing steps for transferring ink from a donor substrate to a receiving substrate, according to exemplary embodiments of the present invention.

FIG. 26 provides a flowchart 2800 showing steps for transferring ink from a donor substrate to a receiving substrate. In step 2802, a transfer device having a transfer surface is provided. Next, in step 2804, a donor substrate having a donor surface with ink thereon is provided. In step 2806, at least a portion of the transfer surface is contacted with at least a portion of the ink. When the transfer surface is separated from the donor surface, in step 2808, at least a portion of the ink is transferred from the donor surface to the transfer surface. The transfer surface having the ink disposed thereon is then positioned into alignment with a receiving surface of the receiving substrate, wherein a gap remains between the ink disposed on the transfer surface and the receiving surface, in step 2810. Finally, in step 2812, the transfer device, the ink, or both of the transfer device and the ink are actuated by generating a force that releases at least a portion of the ink from the transfer surface while maintaining at least a portion of said gap, thereby transferring at least a portion of the ink to the receiving surface.

Figure 27A:
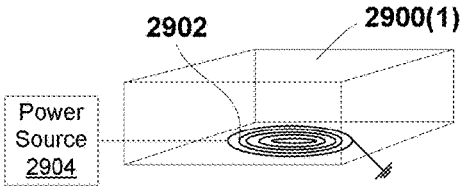
FIGS. 27(A), 27(B): Exemplary means for actuating a FIG. 27(A) transfer device, ink, or FIG. 27(B) both of a transfer device and ink, according to the present invention.

FIG. 27 shows several exemplary means for actuating the transfer device, the ink, or both of the transfer device and the ink in step 2812. FIG. 27A shows a stamp 2900(1) having a conductive coil 2902 embedded in the stamp. A power source 2904 supplies a current within coil 2902 to create resistive heating or a magnetic field.

Figure 27B:
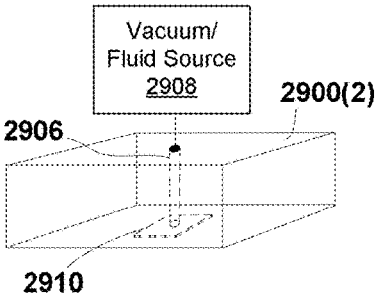

FIG. 27B shows a stamp 2900(2) having a channel 2906 formed therethrough. Ink 2910 is disposed at a distal end of channel 2906, while a vacuum or fluid source 2908 at a proximal end of channel 2906 is in fluidic communication with channel 2906. Using this system, for example, vacuum 2908 may be applied to hold ink 2910 onto the transfer surface until registration is complete. Stopping vacuum 2908 allows ink 2910 to be released from the transfer surface. Alternatively, ink 2910 may be released from the transfer surface upon application of a positive gas pressure, e.g., a short burst of gas. When positive pressure is used to release ink 2910, the gas may replace either a vacuum or neutral pressure. For example, ink 2910 may adhere to the transfer surface in the absence of a vacuum (i.e., under conditions of ambient/neutral pressure).

Figure 28A:
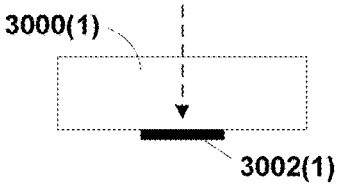
FIGS. 28(A), 28(B)
Figure 28B:
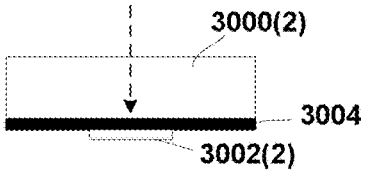

FIGS. 28A and 28B show two exemplary embodiments of the present invention. In FIG. 28A, electromagnetic radiation (shown as a dashed line) passes through a substantially transparent transfer device 3000(1) onto ink 3002(1) adhered to the transfer surface of transfer device 3000(1). The electromagnetic radiation is at least partially absorbed by ink 3002(1) to generate heat within the ink and areas of the transfer surface in contact with ink 3002(1). Alternatively, FIG. 28B shows a transfer device 3000(2) containing embedded, coated, or laminated absorbing material 3004. The absorbing material 3004 may form a contiguous or non-contiguous layer or may be randomly dispersed within or on the transfer device material. Electromagnetic energy (shown as a dashed arrow) is absorbed by absorbing material 3004. Heat created by absorbing material 3004 is transferred to transfer device 3000(2) and ink 3002(2). In one embodiment, absorbing material 3004 is a thermal adhesive or a photoactivated adhesive. In an embodiment, absorbing material 3004 has a coefficient of thermal expansion selected from the range of 300 ppm ° $C.^{-1}$ to 1 ppm ° $C.^{-1}$, a Young's modulus selected from the range of 100 MPa to 500 GPa, a thickness selected from the range of 2 microns to 10 microns, and/or is selected from the group consisting of materials that absorb at the wavelength of irradiation, such as silicon, graphite, carbon black, metals with nanostructured surfaces, and combinations thereof.

In one embodiment, absorbing material 3004 forms a contiguous or non-contiguous coating or laminated layer on the surface of transfer device 3000(2), such that ink 3002(2) is in direct contact with absorbing material 3004. The absorbing material may be applied to the ink or the transfer surface prior to the step of contacting at least a portion of the transfer surface with at least a portion of the ink, and the absorbing material may be removed after the step of applying a force to the transfer surface.

In another embodiment, absorbing material 3004 is embedded within transfer device 3000(2) and disposed within 10 micrometers from the transfer surface upon which ink 3002(2) is adhered. In this embodiment, ink 3002(2) may be protected from excessive heating because the relative heating of transfer device 3000(2) and ink 3002(2) may be preselected by determining the placement, concentration and composition of absorbing material 3004. For example, to minimize heating of ink 3002(2), absorbing material 3004 may be positioned farther from the transfer surface than when greater heating of ink 3002(2) is desired.

Figure 29A:
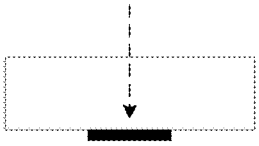
FIGS. 29(A), 29(B), 29(C): Schematics of illumination geometries suitable for use with the present invention.
Figure 29B:
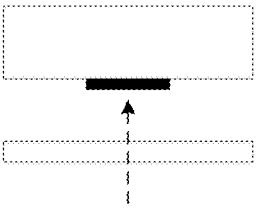
Figure 29C:
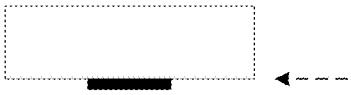

FIGS. 29A-29C provide schematics of illumination geometries suitable for use with the present invention. In FIG. 29A, electromagnetic radiation (shown as a dashed line) passes through a substantially transparent transfer device and is absorbed by ink adhered to the transfer surface of the transfer device. In FIG. 29B, electromagnetic radiation (shown as a dashed line) passes through a substantially transparent receiving substrate and is absorbed by ink adhered to the transfer surface of a transfer device. In FIG. 29C, electromagnetic radiation is applied from the side and at least partially focused onto the interface between the transfer device and ink adhered thereon.

Example 1: Laser-Driven Non-Contact Transfer Printing (LNTP)

Mietl [10] describes a transfer printing process involving both the pick-up of microstructures from a donor substrate and their deposition or 'printing' onto a receiving substrate using an elastomeric stamp. The present invention also starts with an elastomeric stamp made of PDMS and optionally patterned with posts, to selectively engage the desired nano- or micro-devices on the donor or inking substrate. The mechanism for inking the stamp is similar to previously described mechanisms [4-8], relying on the strong adhesive forces between PDMS and the nano- or micro-devices to extract the ink from the donor or inking substrate. For deposition, however, the inked stamp is brought close (between 3 to 10 microns) to the receiving substrate onto which the devices are to be deposited. A pulsed laser beam is focused on the interface between the stamp and the devices to release and drive the device to the receiving substrate. The wavelength of the laser is chosen so that the stamp material is transparent, while the ink is more absorbing. FIG. 1 shows a schematic of the Laser-driven Non-contact Transfer Printing (LNTP) process.

To realize this process, a LNTP print head is created by using an electronically pulsed 30 W 805 nm laser diode with a minimum pulse width of 1 ms. The laser is coupled into the system through a 250 μm core optical fiber. At the end of the fiber are a 4 mm diameter collimator and a focusing lens with a 30 mm focal distance to focus the laser beam on a circular area with a diameter of approximately 400-800 μm. FIG. 2 shows a schematic and photograph of the LNTP print head. The laser beam is brought in through the side of the print head, bent through 90 degrees by a dichroic mirror and focused onto the surface of a (typically, 200×200 μm, 100

μm tall) post patterned on the PDMS stamp. An objective directly above the stamp along with a CCD camera and suitable optics allows the observation of the process with pixel resolution of 1 μm.

The laser print head is tested by using a 2×2 mm, 1 mm thick PDMS stamp with a 200×200 μm, 100 μm tall post patterned on it. The stamp is affixed to a glass backing. For the ink, a donor substrate is fabricated using conventional fabrication processes to obtain anchored, but undercut, 100×100×3 μm square single crystal silicon chips. An automated printer is constructed by integrating a programmable, computer-controlled xyz positioning stage, with the print head, high-resolution optics and vacuum chucks for the donor and receiving substrates. As depicted in the process schematic of FIG. 1, the printer moves and locates the stamp enabling the pick up of a single chip. The stage is then moved to locate the chip directly above a receiving substrate (for example in FIG. 3(*a*), an RC1 cleaned, patterned silicon substrate with 50 micron gold traces) at a distance of 10 microns from it. The laser pulse width was set to 2 ms and the laser power was gradually increased until delamination was observed. FIG. 3(*a*) shows the results of this printing protocol.

A second feasibility test is conducted to demonstrate the construction of 3-dimensional assemblies using such a process. Here a 3-layer pyramid, shown in FIG. 3(*b*), is constructed of the same 100×100×3 μm silicon squares. In a third test, simulating the printing of microstructures into other functional structures, the same square silicon chip is printed onto an AFM cantilever, something that would be difficult to achieve with other processes. (See FIG. 3(*c*).) Finally, FIG. 3(*d*) shows a 320 nm thick silicon chip printed onto a structured surface. This verifies the claim that the process is independent of the properties of the receiving substrate and demonstrates the ability of the process to print ultrathin microstructures.

Figure 4A:
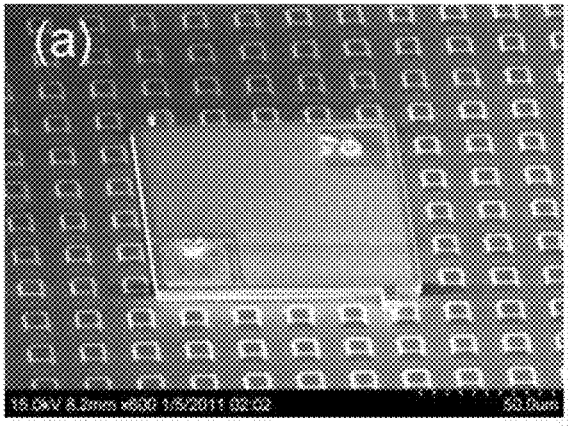
FIGS. 4(A), 4(B), 4(C): Printing InGaN-based μ-LEDs.
Figure 4B:
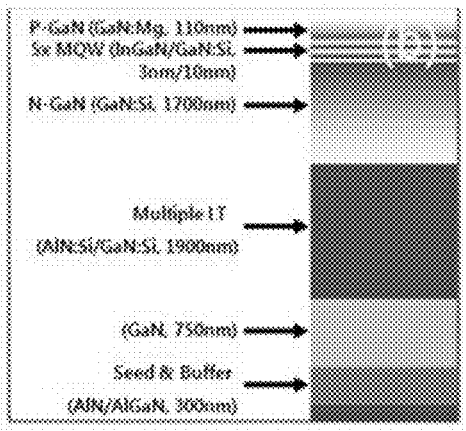
Figure 4C:
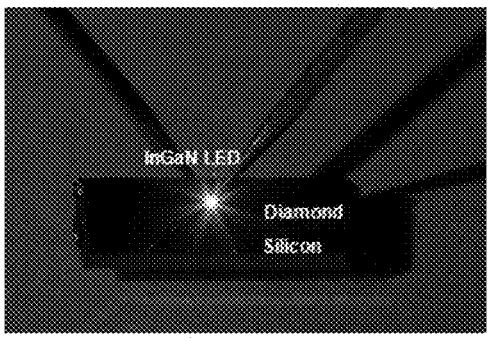

Transfer printing of an InGaN-based μ-LED onto a CVD-grown polycrystalline diamond on silicon substrate is demonstrated in FIG. 4. These InGaN-based μ-LEDs comprise epitaxial layers on a (111) silicon wafer. The active device layers comprise a p-type GaN layer (110 nm of GaN:Mg), multiple quantum well (MQW) (5×InGaN/GaN:Si of 3 nm/10 nm), and an n-type layer (1700 nm of GaN:Si). Metal layers of Ti/Al/Mo/Au (15 nm/60 nm/20 nm/100 nm) and Ni/Au (10 nm/10 nm) are deposited and annealed in optimized conditions to form ohmic contacts to n-GaN and p-GaN, respectively. These LEDs are printed utilizing a single 1 ms laser pulse. FIG. 4(*a*) shows an InGaN-based μ-LED printed onto a structured silicon substrate while FIG. 4(*b*) shows a schematic of the stacks of the InGaN-based μ-LED. FIG. 4(*c*) shows that the μ-LED is functional after having been printed onto a silicon substrate coated with a CVD-grown polycrystalline diamond film.

LNTP Mechanism and Experimental Observations.

The primary phenomenon driving the LNTP process is not ablation but, instead, the mismatched thermo-mechanical responses of the stamp and the ink which cause the delamination of the ink from the stamp and its transfer to the receiving substrate. The mechanism by which the microstructure is delaminated from the stamp and transferred to the receiving substrate is described herein and high-speed photography evidence in support of this mechanism is provided.

Since a PDMS stamp is transparent in the near IR range, the laser radiation is transmitted through the stamp and is incident on the ink which absorbs some fraction of the incident laser energy and, as a result, heats up. The ink, in turn, acts as a heat source for the PDMS stamp, conducting heat across the stamp-ink interface to raise the temperature of the PDMS stamp in the vicinity of the interface. The rise of temperature in the stamp and ink leads to thermal expansions in both. This, due to the considerable difference in the coefficients of thermal expansion for the two materials ($\alpha_s$=310 ppm/° C. for PDMS [11] and $\alpha_c$=2.6 ppm/° C. for Silicon [12]) and the restriction placed on their free expansion by the contact interface between them, must be accommodated by bending (or the formation of a curvature) in the stamp-ink composite. This stresses the interface and, when the energy release rate due to delamination at the interface exceeds the work of adhesion of the interface, the ink is released from the stamp. The increase in bending strain (and hence bending strain energy difference between the stamp and the ink) from the center of the ink to its boundaries and the stress concentration at the discontinuity caused by the boundary of the ink suggest that the delamination by this proposed mechanism will start at the outside boundary/corner of the ink and progress inwards towards its center. This predicted inward propagation of the delamination front is in remarkable contrast to the outward propagation that is observed when ablation of a sacrificial layer or the stamp materials is the mechanism driving the delamination and ejection of the microstructure (See [13]).

To observe the delamination mechanism, the printer's high-resolution camera was replaced with a high-speed camera (Phantom v7.3). Preliminary tests indicated that the illumination produced by the laser pulse was sufficient to produce adequate contrast in the image frames of the camera at speeds up to around 2500 fps. FIG. 5(*a*) shows four frames recoded when working with the laser set to produce a flux of 10 watts for an interval of 0.004 seconds at the stamp. In the frame taken at 2.5 ms after the start of the laser pulse, the delamination process can be clearly observed to have started at the corners of the chip and progressed some distance inwards. By 3 ms the chip has released from the stamp and moved out of focus of the camera (i.e., transferred onto the substrate by 3.5 ms). To better observe the progress of the delamination front, the laser power was gradually decreased to a point where there is not enough strain energy to drive the delamination to completely separate the chip and the stamp. FIG. 5(*b*) shows a situation, observed at a laser power flux of 8 watts for 0.004 seconds, where the delamination front is seen to develop at the corners and propagate inwards towards the center of the chip, but then retract back to the edges and corners of the chip, suggesting insufficient strain energy release to complete the delamination of the chip from the stamp. These observations of the initiation of the delamination front at the outside edges of the chip and its propagation towards the center, along with the fact that the stamp is not damaged and can be used repeatedly for pick up and printing, suggest a thermo-mechanical phenomenon rather than the ablation of the polymer stamp material at the interface.

A Thermo-Mechanical Fracture Mechanics Model for LNTP.

To verify the plausibility of the mechanism proposed, the amount of radiation absorbed by the ink during a typical laser pulse used for printing was measured. This information was then used as the input for analytic and numerical models to determine the temperature of the ink and the stamp at and around the stamp-ink interface. This leads to a high enough energy release rate at the stamp-ink interface that exceeds the work of adhesion such that the ink delaminates from the stamp. Finally, a scaling law for delamination of the stamp-ink interface is established, which governs the critical time for delamination.

Figure 6:
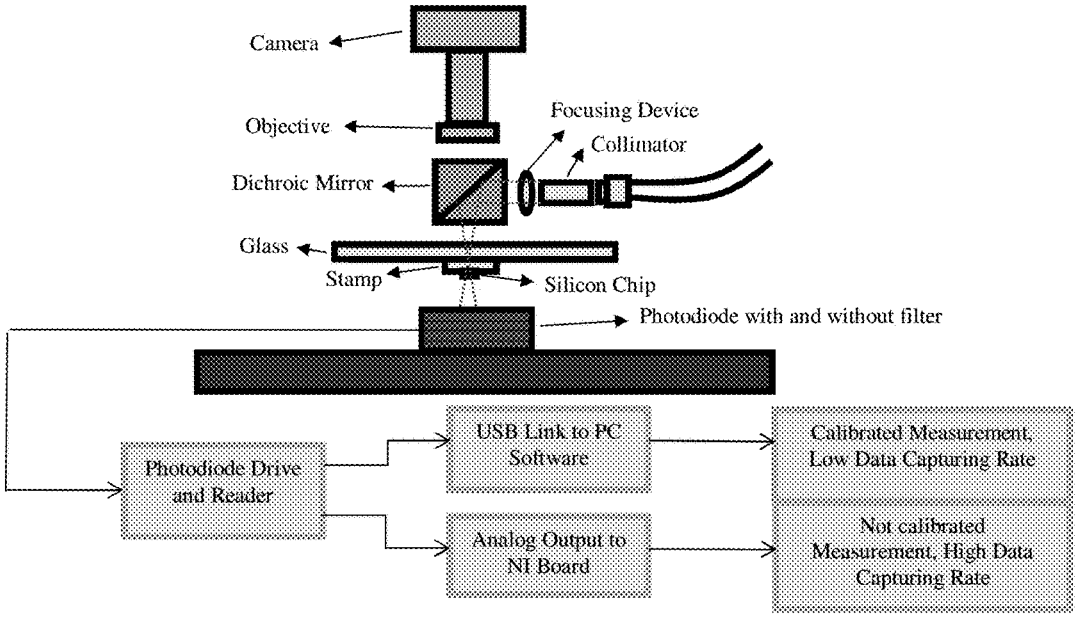
FIG. 6: Schematic of apparatus for measuring laser energy incident on the ink by the difference in energy arriving at a calibrated photodiode with and without the ink present on the stamp.

To measure the heat flux available in a laser pulse used for delamination, the receiving substrate is replaced with a photodiode power meter (Thorlabs S142C) as depicted in FIG. 6. The rest of the setup is maintained exactly the same as originally shown in FIG. 2. The laser beam travels through the optical fiber, collimator and focusing lens, and the dichroic mirror reflects the focused laser beam to the ink (100×100×3 μm silicon chip). Part of the laser beam energy that is incident on the ink is absorbed by it and the rest reflected away by its surface. The remaining energy in the beam passes around the ink (with a negligible amount transmitted through the 3 μm thickness of the chip) and is captured by the photodiode power meter. This power meter is chosen to have a very fast response time (<200 ns) compared to the laser pulse width (4 ms), high optical power range (5 μW-5 W) to withstand the intensity of the beam, high resolution (1 nW) and big laser beam inlet (Ø12 mm) to be able to easily capture the entire laser pulse energy precisely. The photodiode power signal is then translated to laser power utilizing a pre-calibrated reader (Thorlabs PM100D). A data acquisition card captures the analog output of the calibrated reader at a sampling rate of 40 kHz and stores it on a PC for subsequent analysis.

This experiment is performed in two steps: in the first stage the ink is loaded on the stamp and subjected to a 4 ms long laser pulse with intensity just below that needed to produce delamination. The photodiode power meter measures the energy in the laser pulse that passes around the chip. In the second step of this measurement, the ink is removed from the stamp and the same 4 ms laser pulse is sent to the stamp with the photodiode power meter measuring the energy in the laser pulse that emerges out from the stamp. The difference between these two measurements is the energy in the pulse that is absorbed by the ink.

Figure 7:
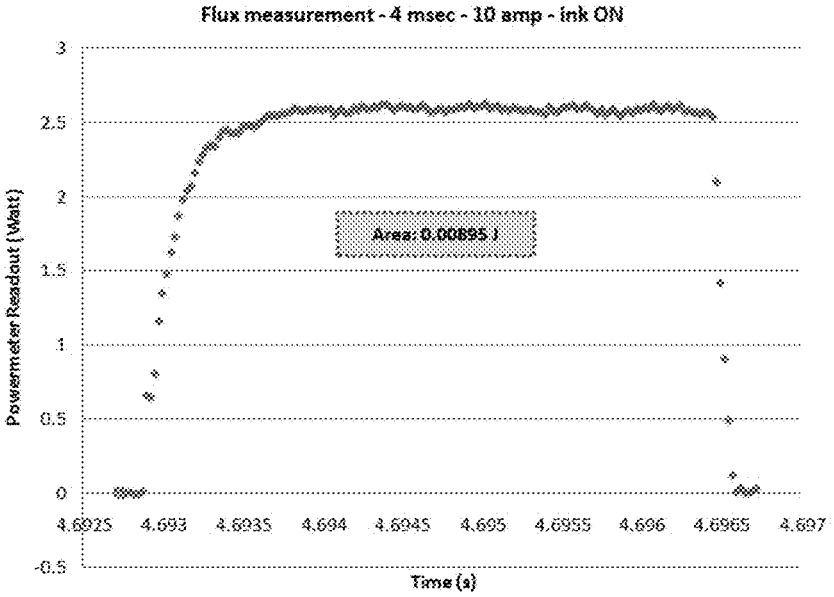
FIG. 7: Power meter measurements with the ink on the stamp for a single 4 millisecond long laser pulse.
Figure 8:
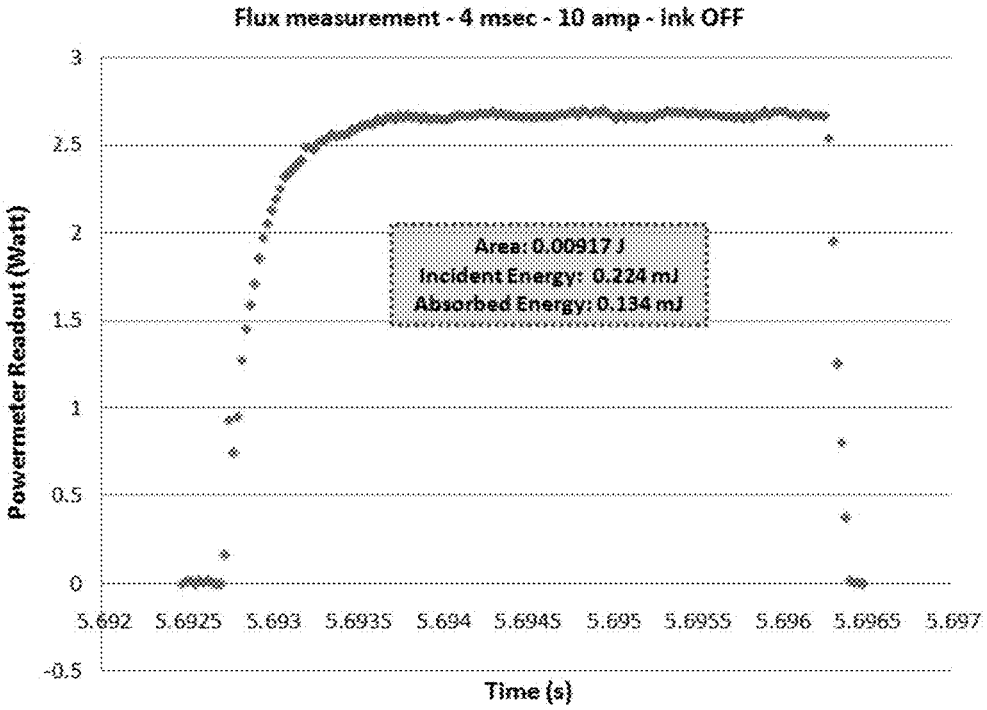
FIG. 8: Power meter measurement with no ink on the stamp for a single 4 ms long laser pulse.

FIGS. 7 and 8 show the power meter measurements with and without the ink on the stamp, respectively. As shown in FIG. 7, the photodiode power meter receives 0.00895 Joules during a 4 ms laser pulse with the ink loaded on the stamp and, as shown in FIG. 8, it receives 0.00917 Joules for the identical laser pulse when there is no ink loaded on the stamp. Therefore, the incident energy to the silicon ink during a 4 ms laser pulse is 0.224 mJ, the difference between these two values. For the absorptivity 0.672 of the silicon chip [14], the energy absorbed by the silicon chip is 0.151 mJ. This energy heats up the ink and the PDMS stamp across the stamp-ink contact interface to drive the delamination.

Finite element method [15] is used in the transient heat transfer analysis. The top surface of the glass backing layer is fixed, and the top surface of the silicon chip is constrained to move with the bottom surface of the post on the PDMS stamp. Other surfaces in this model are free to move. As explained earlier, the silicon chip absorbs part of the incident laser energy and behaves as a heat source. As indicated by the experimental measurements, the heat source here is the silicon chip or ink surface at the stamp-ink interface that inputs 0.151 mJ of energy over a 4 ms interval, that is, 0.0376 W of power. Finite element analysis is performed for a 4 ms interval of time. An axisymmetric model is used and hence the equivalent radius of the silicon chip is 56 μm with a same in-plane area as the 100×100 μm square chip.

FIGS. 9(*a*) and 9(*b*) show the temperature distribution in the cross section cut along the center line of the ink, at 1.8 ms. This is approximately the time when delamination starts because the analysis gives the energy release rate 0.15 J/m$^2$ (FIG. 9(*c*)) at 1.8 ms, which just reaches the work of adhesion 0.15 J/m$^2$ for the stamp-ink interface reported in the literature [16], suggesting the start of delamination. This distribution of temperature is expected, considering the high thermal conduction coefficient of silicon and low thermal conduction coefficient of PDMS and the fact that most of the laser energy is absorbed in the silicon chip and PDMS is almost transparent at the laser wavelength utilized. The analysis suggests that most of the deformation occurs in the PDMS close to the silicon chip while the chip itself undergoes a trivial deformation. This is expected considering the mismatch in thermal expansion coefficients and the stiffnesses of silicon and PDMS. Also, the PDMS bulges to accommodate the difference in thermal strains between the ink and the stamp. This provides the driving force for the delamination process. FIG. 9(*d*) shows an almost uniform temperature in the ink but a sharp drop to room temperature immediately outside the ink (because of the low thermal conductivity of PDMS).

Figure 10:
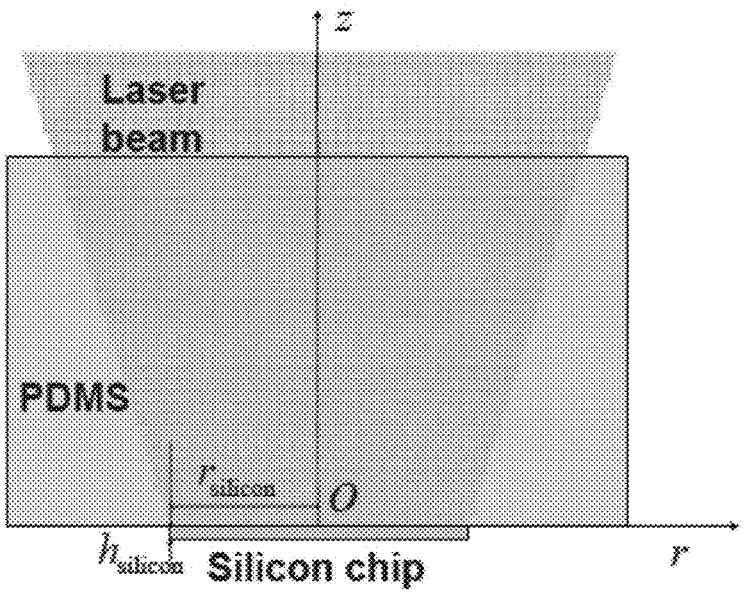
FIG. 10: Analytic model for delamination of stamp-ink interface.

An analytical model is developed to establish a scaling law governing the delamination of the silicon chip from the PDMS post. For simplicity, an axisymmetric model is adopted for the system of the PDMS post and silicon chip (FIG. 10), where $r_{silicon}$=56 μm is the equivalent radius of the square silicon chip by enforcing the same in-plane area, $h_{silicon}$=3 μm is the thickness of the silicon chip. The temperature rise $\Delta T_{PDMS}$ in PDMS (from the ambient temperature) is determined from the transient heat conduction equation $$\frac{\partial^2 \Delta T_{PDMS}}{\partial r^2} + \frac{1}{r}\frac{\partial \Delta T_{PDMS}}{\partial r} + \frac{\partial^2 \Delta T_{PDMS}}{\partial z^2} = \frac{c_{PDMS}\rho_{PDMS}}{\lambda_{PDMS}}\frac{\partial \Delta T_{PDMS}}{\partial t}$$

with the initial condition $\Delta T_{PDMS}|_{t=0}=0$, where $c_{PDMS}$=1460 J·kg$^{-1}$·K$^{-1}$, $\rho_{PDMS}$=970 kg·m$^{-3}$, and $\lambda_{PDMS}$= 0.15 W·m$^{-1}$·K$^{-1}$ are respectively the specific heat, mass density, and heat conductivity of PDMS [11]. The temperature distribution then induces a thermal strain in PDMS, which gives analytically the energy release rate G for the delamination of the stamp-ink interface [17]. For the work of adhesion γ of the stamp-ink interface, the criterion for interface delamination G=γ gives the absorbed laser power P by the silicon chip as a function of critical time t for delamination $$\frac{P\alpha_{PDMS}}{\lambda_{PDMS}}\sqrt{\frac{\mu_{PDMS}}{r_{silicon}\gamma}} = f\left(\frac{\lambda_{PDMS}t}{c_{PDMS}\rho_{PDMS}r_{silicon}^2}, \frac{c_{silicon}\rho_{silicon}h_{silicon}}{c_{PDMS}\rho_{PDMS}r_{silicon}}\right) \quad (1)$$

where $\alpha_{PDMS}$=3.1×10$^{-4}$K$^{-1}$ and $\mu_{PDMS}$=0.67 MPa are respectively the coefficient of thermal expansion and shear modulus of PDMS, $c_{silicon}$=708 J·kg$^{-1}$·K$^{-1}$ and $\rho_{silicon}$=2300 kg·m$^{-3}$[11,18] are respectively the specific heat and mass density of the silicon chip. This suggests that the normalized absorbed laser power $$\frac{P\alpha_{PDMS}}{\lambda_{PDMS}}\sqrt{\frac{\mu_{PDMS}}{r_{silicon}\gamma}}$$

depends on the normalized critical time for delamination $$\frac{\lambda_{PDMS}t}{c_{PDMS}\rho_{PDMS}r_{silicon}^2}$$

via a single non-dimensional combination of the specific heat and mass density of silicon and PDMS, and aspect ratio of silicon chip, $$\frac{c_{silicon}\rho_{silicon}h_{silicon}}{c_{PDMS}\rho_{PDMS}r_{silicon}}.$$

Figure 11:
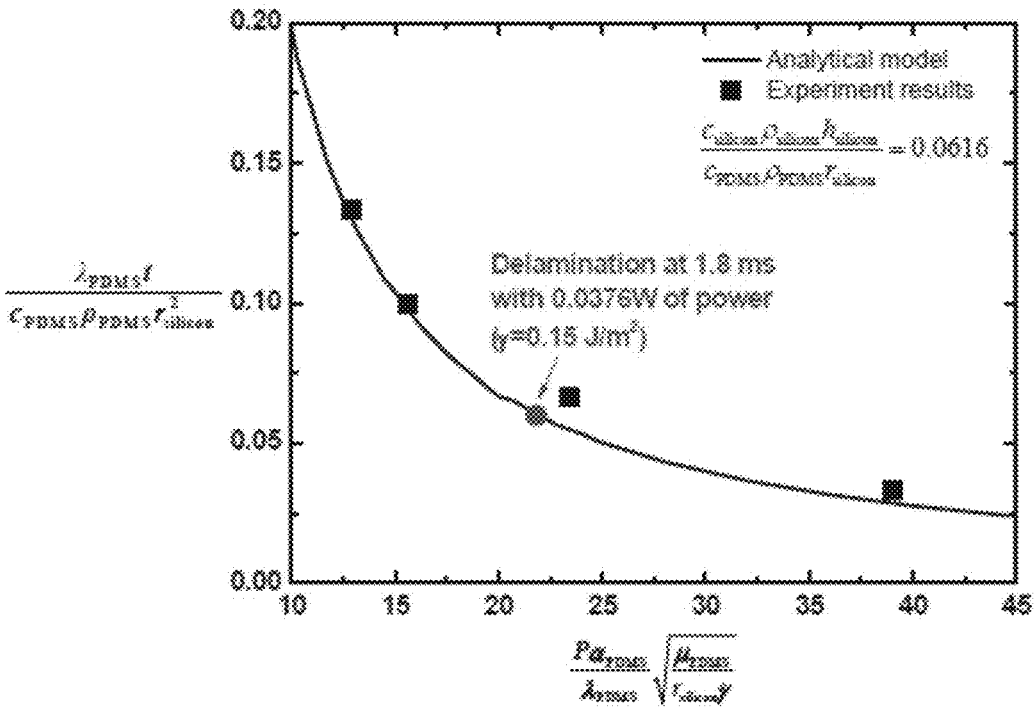
FIG. 11: Scaling law for delamination of stamp-ink interface.

The function, $f$, involves a number of integrals and is evaluated numerically to produce the curve shown in FIG. 11 with $$\frac{c_{silicon}\rho_{silicon}h_{silicon}}{c_{PDMS}\rho_{PDMS}r_{silicon}} = 0.0616$$

for the situation being modeled. For the situation reported in the experiment and used in the FEA model, P=0.0376, gave the critical time for delamination to be 1.8 ms. This is indicated by the circular red dot on the graph, agreeing well with the analytical model's prediction.

To further verify the scaling law, an experiment was conducted in which the pulse time was kept constant and the laser power was gradually increased until delamination occurred. The incident power of the silicon chip corresponding to these conditions was measured as previously described at the beginning of this section (see FIG. 6). In this manner, the incident power necessary for complete delamination was obtained for pulse widths ranging from 1 to 4 ms. Taking the pulse width as a rough approximation of the start of delamination (in fact, this would be a slight overestimation of delamination time, because when complete delamination occurred, it typically occurred within a 0.5 ms interval), the black squares are plotted on the graph of FIG. 11. For pulse widths of 1, 2, 3 and 4 ms, the corresponding absorbed laser power by the silicon chip in experiments was 0.0672, 0.0403, 0.0269 and 0.0222 W, respectively. These suggest that the experimentally observed delamination times agree well with the scaling law obtained from the analytical model.

Conclusions and Discussions.

A millisecond laser pulse from a near infrared diode laser with power in the tens of watts was focused at the interface between a transparent stamp (of PDMS) and absorbing microdevices (of SCS, GAAS and GAN) 'ink', that have about a 2 orders of magnitude difference in the coefficient of thermal expansion. The strain energy release rate generated at the stamp-ink interface is sufficient to overcome the work of adhesion at the interface, and therefore results in the release and transfer of the microdevice from the stamp to a nearby receiving substrate. High-speed photography evidence clearly shows the delamination process is resulting from the elastic mismatch strain when the temperature of the stamp-ink system is raised. Measurements of IR flux incident on the chip, coupled with analytical and numerical models further validate the approach.

Because the stamp is not damaged during this process, it is possible to use this as the basis of a simple, pick-and-place assembly process for assembling 3-D microdevices that cannot easily be fabricated by other processes, as well as for printing functional microdevices into or onto different substrates to enable emerging technologies such as flexible and stretchable electronics. This ability to transfer microdevices from a PDMS stamp to different receiving substrates has been integrated into 'printer' by creating a laser print head and installing it into a computer controlled positioning stage. The full printing cycle, i.e. extracting microdevices from the growth/fabrication substrate and assembling them on a receiving substrate has been successfully implemented and successfully demonstrated for a number of cases where such transfer would be difficult, if not impossible.

One challenge in laser-driven transfer printing is to reduce the temperatures at which delamination and transfer occur. Increasing the laser power increases strain energy release rate and facilitates delamination at the stamp-ink interface. But, it also increases the temperatures of the microdevice and the stamp. The analytical and numerical models presented above suggest that effective methods to reduce the stamp temperature include increasing the elastic modulus, coefficients of thermal expansion and thermal conductivity, the specific heat, mass density, and thickness of the ink. Decreasing the specific heat and mass density of the stamp also help to reduce the temperatures reached during the process.

REFERENCES

[1] R. Wartena, A. E. Curtright, C. B. Arnold, A. Piqué, and K. E. Swider-Lyons, "Li-ion Microbatteries Generated by a Laser Direct-Write Method," *Journal of Power Sources,* 126 (1-2), 193-202 (2004).

[2] J. Bohandy, B. F. Kim, and F. J. Adrian, "Metal deposition from a supported metal film using an excimer laser, *Journal of Applied Physics,* 60, 1538 (1986).

[3] A. S. Holmes, S. M. Saidam, "Sacrificial layer process with laser-driven release for batch assembly operations," Journal of Microelectromechanical Systems, 7 (4) (1998).

[4] Y-L. Loo, D. V. Lang, J. A. Rogers and J. W. P. Hsu, "Electrical Contacts to Molecular Layers by Nanotransfer Printing," *Nano Letters,* 3(7), 913-917 (2003).

[5] J. Zaumseil, M. A. Meitl, J. W. P. Hsu, B. Acharya, K. W. Baldwin, Y-L. Loo and J. A. Rogers, "Three-dimensional and Multilayer Nanostructures Formed by Nanotransfer Printing," *Nano Letters,* 3(9), 1223-1227 (2003).

[6] E. Menard, L. Bilhaut, J. Zaumseil, and J. A. Rogers, "Improved Chemistries, Thin Film Deposition Techniques and Stamp Designs for Nanotransfer Printing," *Langmuir,* 20(16), 6871-6878 (2004).

[7] M. A. Meitl, Y. Zhou, A. Gaur, S. Jeon, M. L. Usrey, M. S. Strano and J. A. Rogers, "Solution Casting and Transfer Printing Single-Walled Carbon Nanotube Films," *Nano Letters,* 4(9), 1643-1647 (2004).

[8] Y. Sun and J. A. Rogers, "Fabricating Semiconductor Nano/Microwires and Transfer Printing Ordered Arrays of Them onto Plastic Substrates," *Nano Letters,* 4(10), 1953-1959 (2004).

[9] A. Pique, S. Mathews R. Auyeung, and B. Pratap Sood, "Laser-based technique for the transfer and embedding of electronic components and devices," United States Patent Application 20090217517.

[10] M. S. Meitl, Z. T. Zhu, V. Kumar, K. J. Lee, X. Feng, Y. Y. Huang, I. Adesida, R. G. Nuzzo, and J. A. Rogers, "Transfer printing by kinetic control of adhesion to an elastomer stamp, *Nature Mat.* 5, 33-38 (2006).

[11] J. E. Mark (ed.), "Polymer Data Handbook", Oxford University Press, New York (1999).

[12] Y. Okada, and Y. Tokumaru, "Precise determination of lattice parameter and thermal expansion coefficient of silicon between 300 and 1500K," *J. Appl. Phys.,* 56 (2), 314-320 (1984).

[13] A. S. Holmes, S. M. Saidam, "Sacrificial layer process with laser-driven release for batch assembly operations," Journal of Microelectromechanical Systems, 7 (4) (1998).

[14] M. A. Green, and M. J. Keevers, "Optical Properties of Intrinsic Silicon at 300 K," *Progress in Photovoltaics,* 3 (3), 189-192 (1995).

[15] ABAQUS Analysis User's Manual V6.9 (Dassault Systémes, Pawtucket, R I, 2009).

[16] S. Kim, J. Wu, A. Carlson, S. H. Jin, A. Kovalsky, P. Glass, Z. Liu, N. Ahmed, S. L. Elgan, W. Chen, P. M. Ferreira, M. Sitti, Y. Huang and J. A. Rogers, "Micro-structured Elastomeric Surfaces with Reversible Adhesion and Examples of Their Use in Deterministic Assembly by Transfer Printing," *Proceedings of the National Academy of Sciences USA* 107 (40), 17095-17100 (2010).

[17] Z. Suo, "Singularities interacting with interfaces and cracks," *International Journal of Solids and Structures,* 25(10), 1133-1142 (1989).

[18] S. A. Campbell, "The Science and Engineering of Microelectronic Fabrication", Oxford University Press, New York (2001).

Example 2: Laser-Driven Non-Contact Transfer Printing (LNTP) onto Liquid Substrates The LNTP process of the present invention can be used to transfer micro- or nano-devices (ink) to receiving substrates having various surface characteristics because the LNTP process is independent of receiving surface characteristics. For example, the receiving surface may be planar, rough, charged, neutral, non-planar, and/or contoured.

Figure 12A:
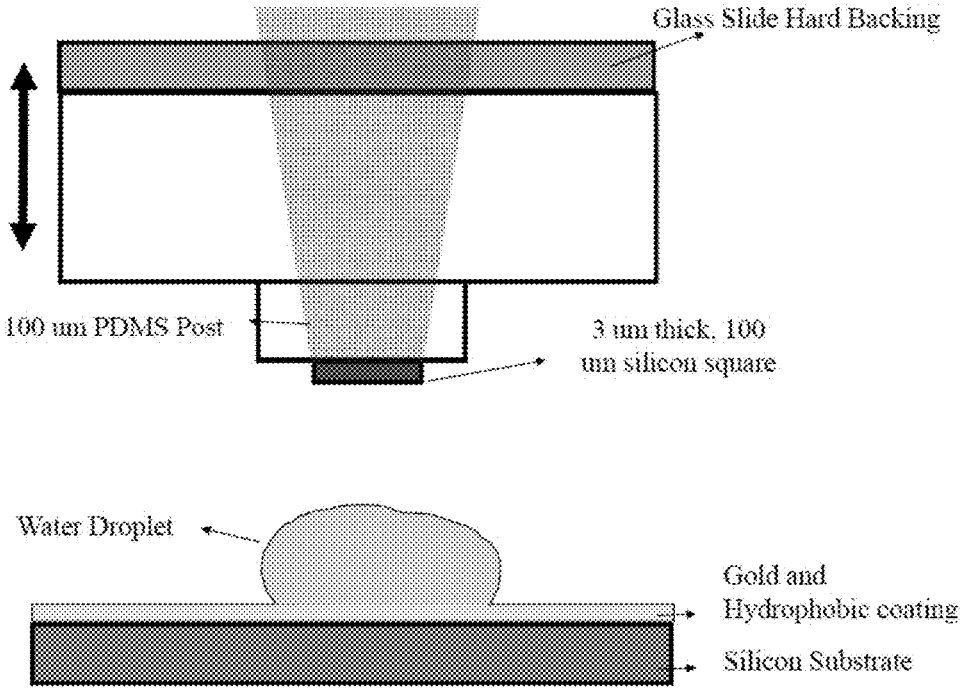
FIGS. 12(A), 12(B): A schematic depiction FIG. 12(A) and photograph FIG. 12(B) of the laser-driven non-contact transfer printing (LNTP) of a silicon square onto a water droplet.
Figure 12B:
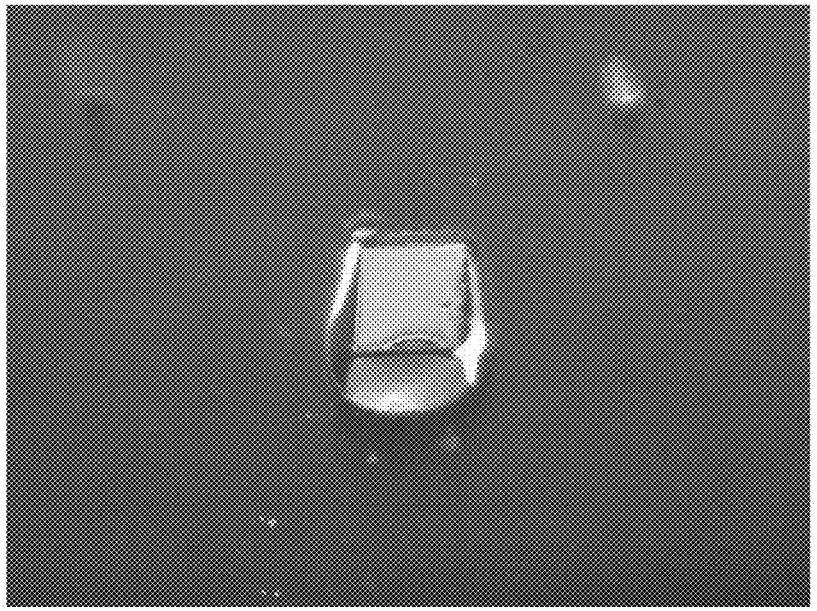

The present example demonstrates the applicability of the LNTP methods to liquids, biological cells, and the like. In the present example, a glass-backed transfer stamp having a 100 μm PDMS post was used to transfer a 3 μm thick×100 μm×100 μm silicon chip onto a water droplet disposed on a hydrophobic gold coating. The hydrophobicity of the gold coating causes the water droplet to present a highly spherical surface for receiving the silicon chip. A schematic of the technique is shown in FIG. 12(*a*) and a photograph of the silicon chip after transfer to the surface of the water droplet is shown in FIG. 12(*b*).

Example 3: A Prototype Printer for Laser Driven Micro-Transfer Printing

This Example demonstrates a new mode of automated micro transfer printing called laser micro transfer printing (LμTP). As a process, micro-transfer printing provides a unique and critical manufacturing route to extracting active microstructures from growth substrates and deterministically assembling them into or onto a variety of functional substrates ranging from polymers to glasses and ceramics and metallic foils to support applications such as flexible, large-area electronics, concentrating photovoltaics and displays. Laser transfer printing extends micro-transfer printing technology by providing a non-contact approach that is insensitive to the preparation and properties of the receiving substrate. It does so by exploiting the difference in the thermo-mechanical responses of the microstructure and transfer printing stamp materials to drive the release of the microstructure or 'ink' from the stamp and its transfer to substrate. This Example describes the process and the physical phenomena that drive it. It focuses on the use of this knowledge to design and test a print head for the process. The print head is used to demonstrate the new printing capabilities that LμTP enables.

Introduction

In Micro-Transfer Printing (μTP), a patterned viscoelastic stamp is used to pick up and transfer functional microstructures made by conventional microfabrication techniques in dense arrays on typical growth/handle substrates (such as silicon, germanium, sapphire or quartz) to a broad range of receiving substrates such as transparent, flexible and stretchable polymers, glass, ceramics and metallic foils. This provides an efficient pathway to the manufacture of flexible electronics and photovoltaics, transparent displays, wearable electronics, conformal bio-compatible sensors and many more [1, 2].

Figure 13:
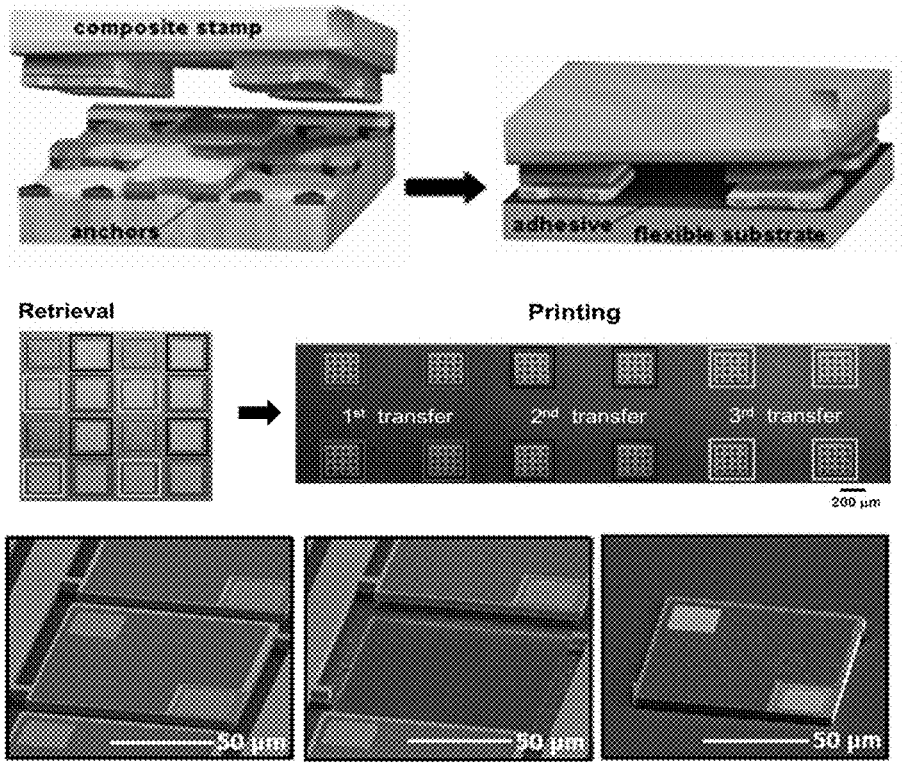
FIG. 13: (top) A patterned stamp with 4 posts retrieves ink from a donor substrate and transfers it to a receiving substrate, (middle) results of 3 printing cycles displaying ink from a dense donor substrate, which is expanded on a receiving substrate, and (bottom) SEM images of representative micro-LED, shown in sequence, (left) donor substrate before retrieval, (center) after retrieval from the Si substrate, and (right) after transfer-printing onto a receiving substrate.
Figure 14:
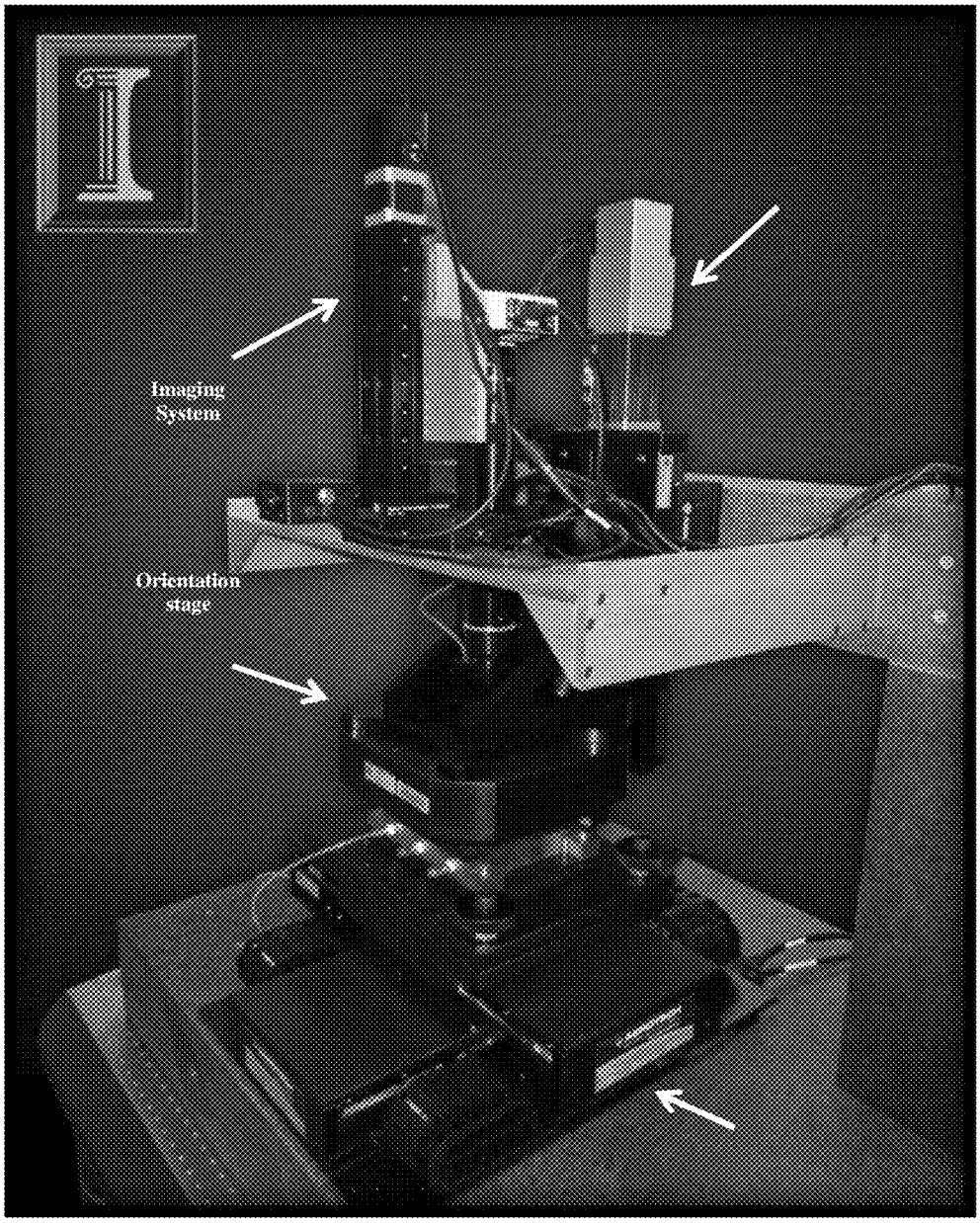
FIG. 14: Automated Transfer Printing Machine showing the four axes of motion and integrated optics.
Figure 15A:
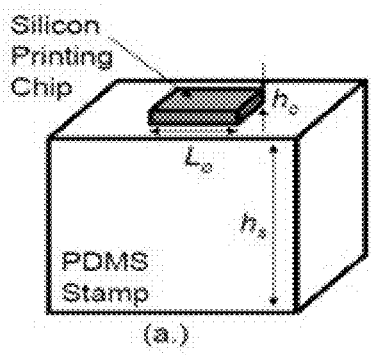
FIGS. 15(A), 15(B), 15(C), 15(D): Schematic of the thermal mismatch strains resulting in bending induced delamination of the silicon printing chip from the PDMS stamp.
Figure 15B:
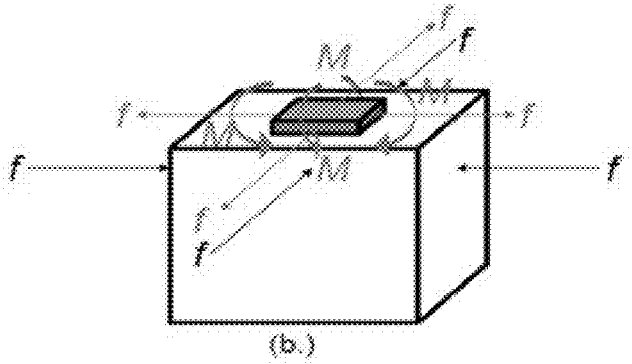
Figure 15C:
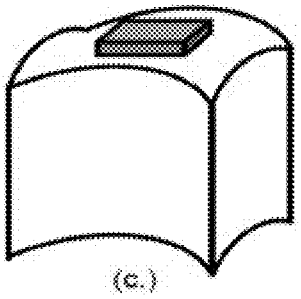
Figure 15D:
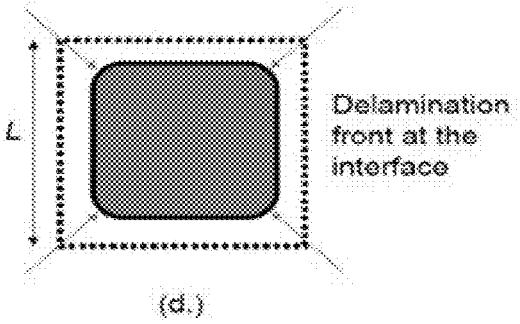

FIG. 13 shows a schematic of the process along with photographs of the donor substrate with microstructures (also referred to as 'ink') and a receiving substrate with printed microstructures. The transfer printing stamp is typically made of molded polydimethylsiloxane (PDMS) and patterned with posts to selectively engage microstructures on the donor substrate. The ink is picked up by adhesion to the PDMS posts. Printing occurs when the 'inked' stamp is subsequently brought into contact with a receiving substrate, followed by a slow withdrawal of the stamp. Adhesiveless transfer printing exploits the viscoelastic rate-dependent adhesion at the stamp-ink interface to enable either retrieval or printing via control of the separation velocity [3,4]. This approach to printing fabricated microstructures without adhesives simplifies downstream processing and is easily automatable by integrating onto a programmable, computer controlled positioning stage. FIG. 14 shows an automated micro-transfer printing machine. The major components of the system include (a) an automated XY-stage for positioning, (b) a Z-stage for moving the stamp up and down and controlling the separation speed and force, (c) an orientation stage that assists in obtaining parallel alignment between stamp and the receiving and donor substrates and (d) an imaging system used for alignment and monitoring of the printing process. The typical size of the printed inks ranges from 10's of microns up to the millimeter scale. The microstructure donor substrate is usually densely packed and can be of centimeter scale. The receiving substrate's dimensions are, in general, several times larger, especially when the ink is sparsely distributed on it. The stamp surfaces are typically patterned with posts with substantially the same lateral dimensions as the microstructures being printed.

While the process is simple and easy to implement, its robustness is dependent on the properties and preparation of the surface of the receiving substrate. For successful printing, the adhesion between the ink and receiving surface must be sufficient to extract the ink from the stamp and, when these conditions are satisfied, the surface must be clean and flat so that good contact is developed with the ink. Thus, printing on low-adhesion surfaces, patterned surfaces or soft gels can be challenging.

The process depicted in FIG. 13 can be scaled into a high transfer-rate, parallel printing process by increasing the number of posts on the stamp. As this parallelism increases, additional challenges accrue. Small misalignments between the substrate and the stamp get magnified as the size of the stamp increases causing substantial variations in the printing conditions at posts in different areas of the stamps leading to printing failures. Failure to print a microstructure in one cycle can result in repeated failures at that post in subsequent cycles, until the residual micro-structure is removed. When large receiving substrates are involved, waviness of the substrates gives rise to non-repeatable variability in printing conditions across the stamp. Finally, when large area expansions are involved, i.e., the printed microstructures have a high pitch or low areal density on the receiving substrates, the stamps used have posts that are spaced far apart and are therefore susceptible to stamp collapse [9,10], especially when larger printing forces are used to compensate for misalignments ('wedge' errors) between the stamp and the substrate. Such collapses result in the peeling out of microstructures by the stamp wherever contact occurs, and can damage both the donor and receiver substrates.

In this Example, a new, non-contact mode for this process is developed that uses a laser to supply the energy required to drive the release of the ink from the stamp and its transfer to the receiving substrate. Since it does not rely on the strength of ink-substrate interface, created by mechanically pressing the ink onto the receiving substrate, to achieve its release from the stamp, the process does not depend on properties or the preparation of the receiving substrate for successful printing. Further, by using a scanned laser beam to address different inks or microstructures on the stamp, high-throughput modes of printing, not susceptible to small wedge errors between the stamp and the substrate, are possible. Thus, this new process mode, called Laser-Driven Micro-Transfer Printing (LμTP), is a highly scalable, robust and versatile printing process.

The next section describes the laser transfer printing process and the phenomena it exploits. It also provides a detailed design of the laser print head for a prototype laser transfer printing tool along with its calibration and testing. The third section demonstrates successful LμTP for situations that would be difficult to achieve with conventional transfer printing. It also explores one important parameter, separation distance of the stamp and receiving substrate on the accuracy of the transfer. Finally, conclusions are discussed.

Laser-Driven Micro-Transfer Printing

Process Description

LμTP builds on micro-transfer printing technology [3, 4]. It uses the same well-developed semiconductor processing technologies for creating donor substrates with dense arrays of printable microstructures, the same materials and techniques for fabricating the transfer stamps, and the stamps are 'inked' with microstructures using the same strategies [3,4]. The critical point of departure is the printing or transfer of the ink from the stamp to the receiving substrate. Instead of using contact-based mechanical means, LμTP uses a pulsed laser beam focused on the interface between the stamp and the microstructure to release and drive the microstructure to the receiving substrate. The wavelength of the laser is chosen so that the stamp material is transparent to the laser while the ink is absorbing, e.g., an IR laser with wavelength 805 nm. Additionally, the stamp material is chosen so as to have a large mismatch in the coefficient of thermal expansion (CTE). For example, in the prototype reported here, single crystal silicon is used as the ink and PDMS as the stamp with CTEs of 2.6 ppm/° C. and 310 ppm/° C. respectively, to produce a CTE mismatch of two orders of magnitude.

FIG. 1 shows a schematic of the LμTP process. For the printing step, the inked stamp is positioned so that the ink is close (about 6-10 microns) to the receiving substrate. A pulsed laser beam is then focused on the interface between the stamp and the ink to cause the transfer of the ink to the substrate. Since a PDMS stamp is transparent in the near IR range, the laser radiation is transmitted through the stamp and is absorbed by the microstructure ink. As a result, the ink heats up and acts as a heat source for the PDMS stamp, conducting heat across the stamp-ink interface to raise the temperature of the PDMS stamp in the vicinity of the interface. The rise of temperature in the stamp and ink leads to thermal expansions in both. Due to the large CTE mismatch for the two materials ($\alpha_s$=310 ppm/° C. [11] for PDMS and $\alpha_c$=2.6 ppm/° C. for silicon [12]) and their free expansion being restricted by the contact interface between them, the thermal strain must be accommodated by bending (or the formation of a curvature) in the stamp-ink composite. This stresses the interface and, when the energy release rate due to delamination at the interface exceeds the work of adhesion of the interface, the ink is released from the stamp.

Bohandy [13] was the first to report a laser-driven deposition process. Holmes and Saidam [14] reported a process called Laser-Driven Release and used it for printing prefabricated metal microstructures from a glass fabrication substrate onto a receiving substrate. Arnold and Pique [15] have reported widely on what they call the Laser-Induced Forward Transfer (LIFT) process. In all these approaches, the driving mechanism is laser ablation at the interface. Much of the reported research uses pico- or femtosecond lasers and sacrificial layers at the microstructure-support structure (stamp) interface with a low vaporization temperature and a high absorptivity at the laser wavelength to enhance the delamination forces produced by ablation. The unique aspects, then, of LμTP, include but are not limited to:

- Use of microsecond scale pulses and reliance on a thermo-mechanical phenomenon based on thermal strain mismatch to drive the transfer printing process;
- Use of lower temperatures (250 to 300° C. instead of temperatures reaching 1000° C.), which leads to less damage to active microstructures.
- the stamp properties are tuned to achieve both extraction of ink from the donor substrate and deposition onto the receiving substrate
- the stamp remains substantially undamaged (because the process is driven by a reversible physical strain in the stamp rather than an irreversible chemical change in it), thus enabling a repeated pick-and-place process mode.

Detailed modeling and analysis of the process are described in [23]. This Example concentrates on the design of the printing tool for the process.

Prototype Laser Micro-Transfer Printer Design

A prototype LμTP was developed by designing a printhead and integrating it with an xyz-positioning stage. A schematic of the print head is shown in FIG. 6. The print head was developed so that printing could be observed through the stamp. The laser radiation is brought into the system via an optical cable from one side of the print head. A dichroic mirror is used to direct the laser beam towards the stamp below it. A GRIN lens at the end of the optical cable is used to focus the laser beam on the ink.

One of the first steps in the realization of the schematic of the prototype print head of FIG. 6 was to estimate the power requirements (i.e., size the laser for the print head) and perform an analysis of whether a thermo-mechanical delamination process was possible without damaging the PDMS stamp. For this analysis (and for experimental verification) a single crystal silicon square with a lateral dimension of 100 microns and a thickness of 3 microns was used as the model or representative ink. First, temperatures at which thermal mismatch strains in the Si-PDMS system give rise to energy release rates sufficient to overcome the work of adhesion at the Si-PDMS interface were calculated. The power of the laser system required to drive the steady state temperature of this system past the delamination temperature was then computed.

To compute the delamination temperature, the approach originally proposed by Stoney [16] for an infinitely thin film as modified by Freund [17] for finite film thickness was used. Silicon was used as the thin film (thickness, $h_c$=3 μm) and PDMS as the substrate (thickness, $h_s$=100 μm) to model film delamination. As previously mentioned, the PDMS stamp has a higher coefficient of thermal expansion; thus, when heated, the PDMS expands more than the Si ink, although the expansion is constrained due to a common interface shared by the two materials. As a result, strains accrue in both materials. To estimate this strain, a constant, uniform temperature distribution throughout the ink and the immediate vicinity of the post on the stamp was assumed. The strain energy exists solely because of an incompatible elastic mismatch strain that arises when the temperature is increased by an amount ΔT above room temperature (the conditions at which the interface was created) due to heating by laser pulse, as no external applied tractions or stresses exist in the system. Consequently, the Si chip undergoes a biaxial tensile stress; assuming the printing chip is an isotropic, elastic, homogenous material; its strain energy density at the interface is given by, $U(z=\frac{1}{2}h_s)$:

$$U\Big|_{z=\frac{h_s}{2}} = \frac{E_c}{1-\upsilon_c}\left(\varepsilon_o - \kappa\frac{h_s}{2} + \varepsilon_m\right)^2 \tag{1}$$

where the elastic modulus ($E_c$=179.4 GPa) and Poisson ratio ($\nu_c$=0.28) denote the elastic constants of silicon [3]. Hence, the strain energy density is composed of the midplane extensional strain, $\in_0$, the strain arising from the mismatch in thermal expansion coefficients between the chip and substrate, $\in_m$, and the curvature, κ, of the chip about a center of curvature equivalent to half of the substrate's thickness, $h_s/2$. The mismatch in thermal expansion coefficients of the stamp and chip produces a strain, $\in_m=(\alpha_s-\alpha_c)\Delta T$.

The potential energy, V, is found by integrating Equation 1 with respect to the height of the system. By taking the variants of the potential energy and checking for stability of the system (i.e. $\partial V/\partial\in_0=0$ and $\partial V/\partial\kappa=0$), two equations and two unknowns are obtained, the midplane extensional strain ($\in_0$) and the curvature (κ), that can be solved to yield:

$$\kappa = \frac{\kappa_{st}(1+h)}{[1+4hm+6h^2m+4h^3m+h^4m^2]}, \tag{2a}$$

$$\varepsilon_o = \frac{\varepsilon_{st}(1+h^3m)}{[1+4hm+6h^2m+4h^3m+h^4m^2]}, \tag{2b}$$

$$\text{where } \kappa_{st} = \frac{6\varepsilon_m}{h_s}hm \text{ and } \varepsilon_{st} = -\varepsilon_m hm.$$

In these equations, shorthand notation is used where h ($=h_c/h_s$) and m ($=E_c*(1-\nu_s)/E_s(1-\nu_c)$) refer to the ratios of the thicknesses and biaxial moduli of the chip to the substrate, respectively. Also, $\kappa_{st}$ and $\in_{st}$ refer to the solution of the Stoney equation, where the chip is infinitely thin. From this analysis, the stress in the chip at the interface is given by:

$$\sigma_c = \frac{E_c}{1-\upsilon_c}\left(\varepsilon_o - \kappa\frac{h_s}{2} + \varepsilon_m\right). \tag{3}$$

Figure 16:
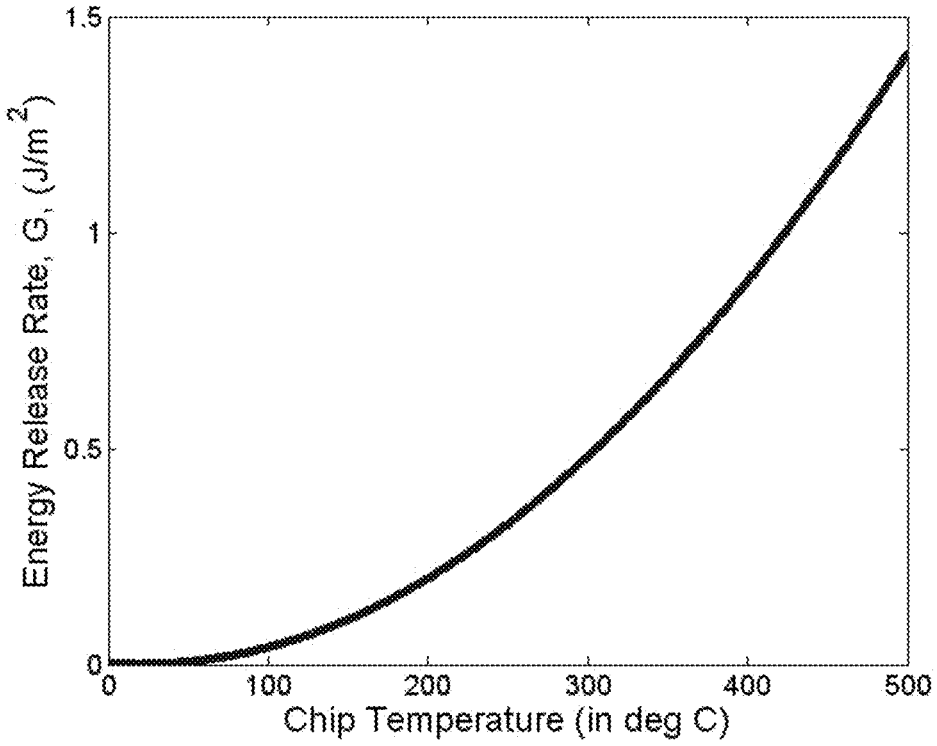
FIG. 16: The energy release rate of the PDMS-100×100×3 mm silicon ink-stamp system as a function of chip temperature is calculated by the finite-thickness correction to Stoney's formulation [16] by Freund [17].

The strain energy accumulation in the system is relieved by deformation, giving rise to a curvature of the microstructure/stamp system, as shown in FIG. 15. The bending strain energy associated with this curvature produces the driving force for delamination at the ink-stamp interface. The energy release rate associated with such delamination due to relaxation of bending strain is given by:

$$G = \frac{1-\upsilon_c^2}{2E_c}(\sigma_c - \sigma_a)^2 h_c \tag{4}$$

where $\sigma_a$ is the applied external stress [26], which is zero in this case. When this energy release rate is greater than the adhesion energy of the Si-PDMS interface, one can expect delamination to occur and the ink to be released from the stamp. The above analysis was used to arrive at a relationship between the energy release rate, G ($J/m^2$), and the temperature to which the system is raised above room temperature, ΔT (° C.). This is shown in FIG. 16.

A number of investigators have reported values in the range of 0.05 to 0.4 $J/m^2$ for the adhesion energy of Si-PDMS interfaces [4, 10, 18-20]. From FIG. 16, choosing a conservative value of 0.5 $J/m^2$ for G, produces a corresponding delamination temperature between 275-300° C. This value is well within the range that PDMS can withstand without decomposing, especially for short, millisecond, durations [21].

Figure 17:
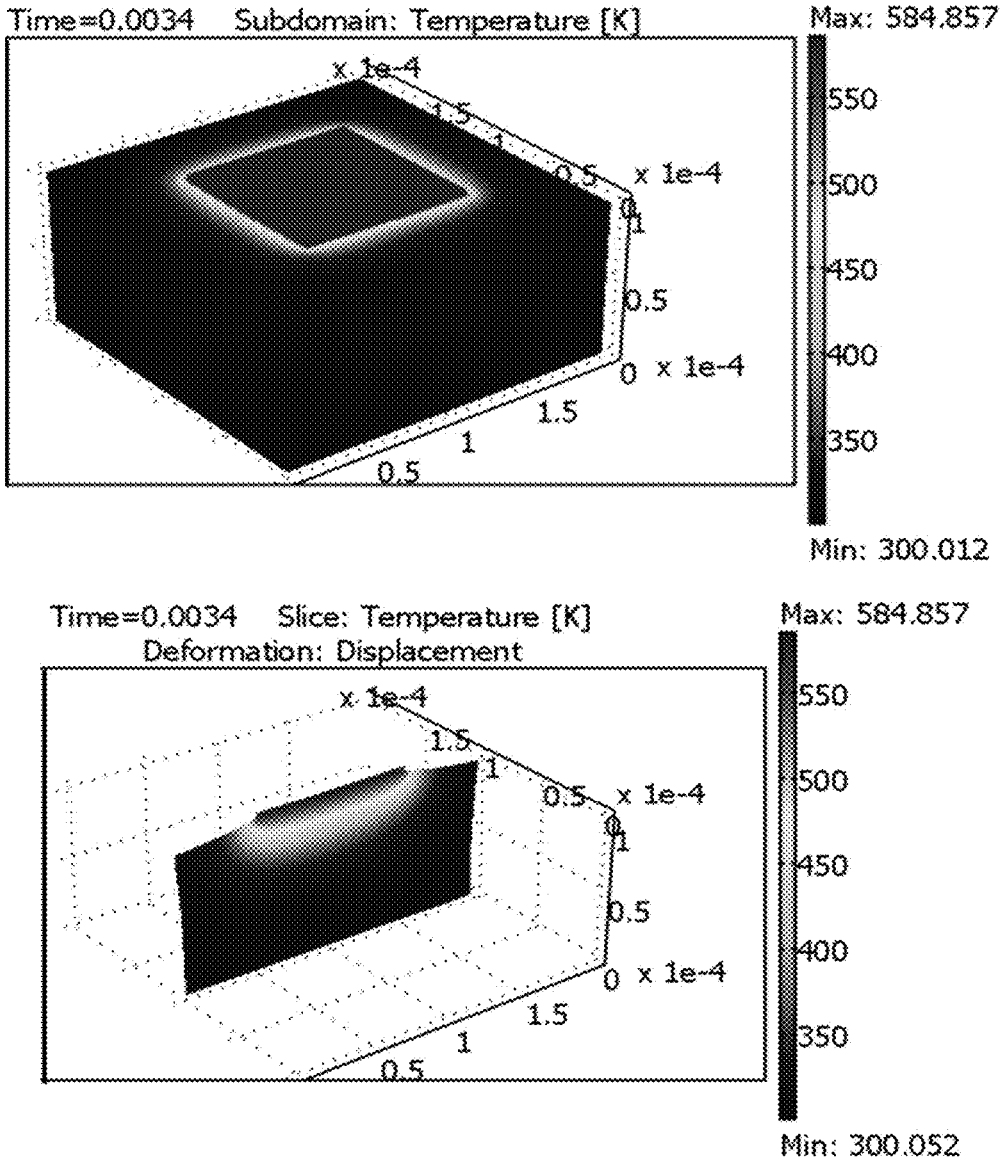
FIG. 17: Finite element model of the post and ink showing (top) temperature gradient in the post and attached ink and (bottom) a slice of the post showing the temperature gradients and the deformation.

As stated in the description of the process, the laser heats up the Si ink that, in turn, heats up the interface and the PDMS in the vicinity. To achieve this, a COMSOL® finite element model was used with the Si ink acting as the heat source. The strength of the heat source was varied and the corresponding steady state temperatures were computed. FIG. 17 shows the schematic of the model with a 100×100×3 μm thick silicon chip attached to a 200×200×100 μm high PDMS post. The bottom surface of the PDMS stamp (in FIG. 17) is fixed and the bottom surface of the silicon ink is constrained to move with the top surface of the post on the PDMS stamp. Other surfaces in this model are free to move. The heat source in the model is the square-shaped area at the stamp-ink interface. The exposed surfaces of the silicon and PDMS lose heat to the surroundings by convection. The model uses 75000 nodes to perform a transient heat transfer analysis in COMSOL 3.5 for run intervals up to 5 milliseconds (typical laser pulse times range from 1 to 5 ms) with the silicon ink, PDMS and surroundings initially at 27° C. FIG. 17 shows the results of one run, in which 135 mJ of heat is input into the system over a 3.4 millisecond interval. From this simulation, one can see that the temperatures reached in the system are about 584 K, slightly higher than 300° C., sufficient to cause delamination without damaging the stamp.

From this value of heat input rate, it is possible to approximate to 150 mJ over 4 ms or 0.0375 W and to calculate the power required in the laser pulse, but one must account for reflective and transmission losses as well as for the intensity distribution in the beam. For 800 nm radiation, the coefficient of absorption for silicon, $\alpha_c=10^3$ $cm^{-1}$ or its absorption depth is about 10 μm. The intensity of the radiation emerging from a 3 μm thick sheet of silicon as a fraction of the intensity of the incident radiation, $I_0$, is given by:

$$\frac{I}{I_0} = \exp(-\alpha_c h) \tag{5}$$

which for h=3 μm becomes approximately 0.75. With 75% of the radiation lost to transmission, only 25% of the radiation that enters the silicon is available for heating the ink. Dealing next with the fraction of the beam area that is incident on the silicon ink, one major consideration is to uniformly heat the ink across its lateral dimension. If one considers a Gaussian beam, then too small of a beam diameter will result in a hot spot at the center of the ink. The power, P(r), contained within a radius r of the beam is given by (see, for example, [22]):

$$P(r) = P(\infty)\left[1 - \exp\left(\frac{-2r^2}{\omega_0^2}\right)\right] \tag{6}$$

where $P(\infty)$ is the total power in the beam and $\omega_0$ is the beam radius. For $r=0.23\ \omega_0$, the intensity drop from the beam center to the perimeter of the circle is 0.1 or 10%. This will provide relatively uniform heating, but only 10% of the beam energy is contained in the circle. Finally, one must deal with the reflectivity of polished silicon, which at 800 nm is 0.328. Thus only 67.2% of the radiation incident on the ink is absorbed by, or transmitted through, it.

In summary, to provide the required 0.0375 W of heating, the beam power in the plane of the ink-stamp interface must be:

$$P = \frac{0.0375}{0.25 * 0.1 * 0.672} \simeq 2.25\ \text{W} \tag{7}$$

Thus, it is not only feasible to thermo-mechanically delaminate the model silicon ink from the PDMS stamp by exploiting the mismatch in CTEs, it is possible to do so with a moderately powered diode laser.

Figure 18:
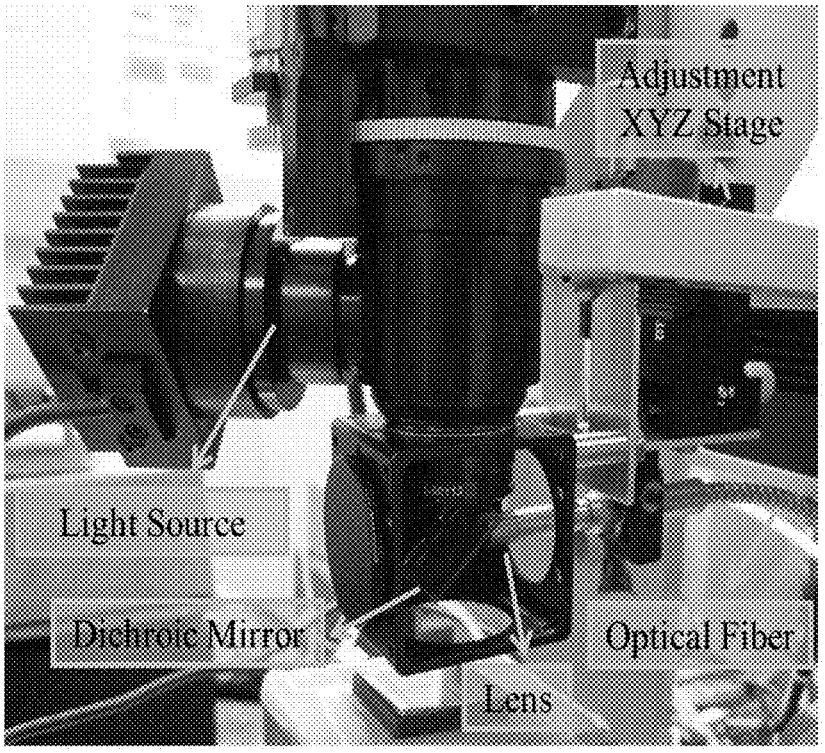
FIG. 18: Photograph of the laser micro-transfer print head.

FIG. 18 shows a photograph of the print head. A Jenoptik® continuous wave, fiber-coupled (fiber core diameter of 0.2 mm), passively-cooled, 808 nm 30 W laser diode with electronic pulse control is used. A higher power rating was chosen to be able to account for losses in the coupling and cable, and to accommodate different materials and thinner and larger lateral dimension inks. The pulse resolution for the laser is 1 millisecond. The print head is integrated onto a custom-assembled, gantry-type XYZ positioning stage. The stage has 1 micron resolution, 150 mm of travel in the X and Y directions and 100 mm of travel in the Z direction. It is fitted with high (1 mm) resolution optics, capable of observing the process through the stamp. Except for the difference in the print head, the structure of the printer is very much like that shown in FIG. 14.

Calibration and Testing

The prototype printer along with the laser printing head is calibrated to relate the beam power available at the ink-stamp interface for different current settings of the laser. Also, the validity numbers used in the analysis and design of the printer are verified.

Figure 19:
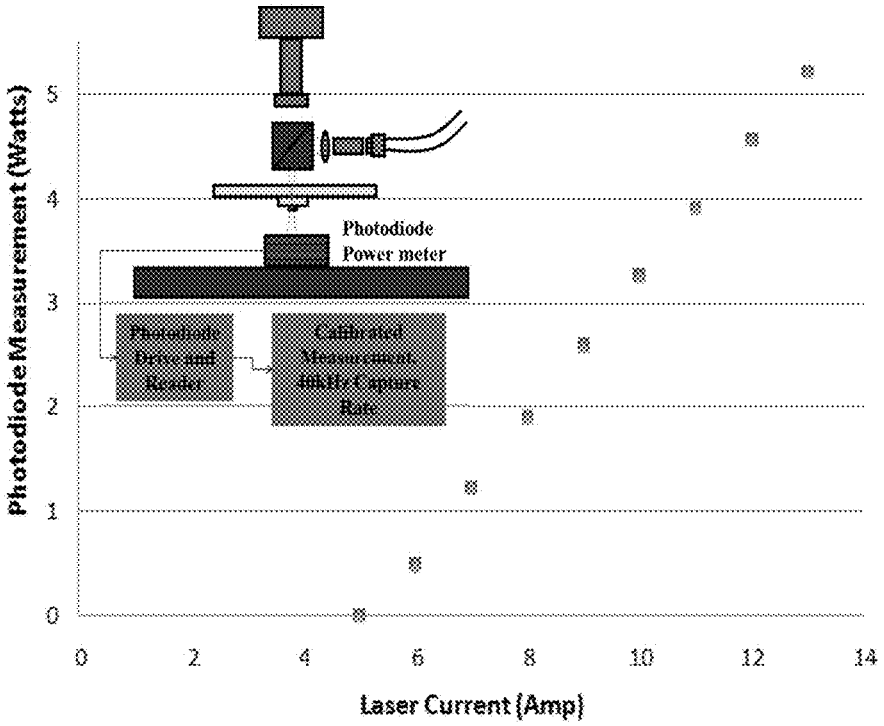
FIG. 19: Beam power at the stamp-ink interface plane as a function of the laser current.

To relate the current settings on the laser and the beam energy as it arrives at the stamp-ink interface, a photodiode power meter with a pre-calibrated reader (Thorlabs PM100D) is used, as shown in the schematic of FIG. 19. This power meter is chosen to have a very fast response time (<200 ns) compared to the laser pulse width (typically >1 ms), high optical power range (5 μW-5 W) to withstand the intensity of the beam, high resolution (1 nW) and large inlet aperture (Ø12 mm) to be able to easily capture the entire laser beam during a pulse. A data acquisition card captures the analog output of the calibrated reader at a sampling rate of 40 kHz and stores it on a PC for subsequent analysis. The laser pulse time is set to 10 ms and the laser is pulsed with different current settings. The readings taken are averaged after those corresponding to the first and last milliseconds of the pulse are deleted to get rid of transients. This is repeated three times for each current setting. As can be seen in FIG. 19, the relationship between beam-power at the ink-stamp interface and the current setting for the laser is linear, with a threshold current of 5 amps. The calibration is done in the current range of 5 amps to 13 amps, with the beam power ranging from 0 to 5.25 watts (sufficient for laser printing, with the model inks)

To verify the delamination conditions previously stated, a two-step experiment is performed. The model ink (100×100×3 mm silicon square) is loaded onto the stamp using the standard transfer printing pick-up step [3, 4]. Next the printing step is attempted. Here the pulse duration is set to 4 ms and pulses of increasing power (obtained by gradually increasing the current) are used until the power level at which transfer occurs is reached. This gives the minimum energy input settings for a 4 ms pulse at which transfer of the ink takes place. After this, the receiving substrate is replaced with the photodiode power meter and two laser power recordings are made with the same pulse times but a current setting just a little bit lower that that needed to achieve transfer. The first measurement is made with the beam passing through an empty stamp and the second is made with the ink on the stamp. Integrating the power measured across the duration of the pulse gives the total energy arriving at the power meter due to the pulse. The difference between the total energy arriving at the photometer with and without the ink gives the sum of the energy reflected and absorbed by the ink. Knowing the reflectivity, it is possible to obtain the energy absorbed by the ink and available for heating the ink. Also, Equation 7 gives the beam power at the plane of the ink-stamp interface required for delamination and transfer to be around 2.25 W. Examining the power recording allows for verification of the design.

FIGS. 7 and 8 show the power recordings by the photodiode power meter. Integrating the areas under the curves, it can be seen that the difference in energy reaching the power meter is 0.224 mJ. Accounting for the reflectance of the silicon inks, energy available for heating the ink is 0.134 mJ, a value very close to that predicted by the thermo-mechanical delamination analysis. Additionally, from this recording, it can be see that the beam power required for delamination is around 2.5 W, while 2.25 W was the computed power requirement. Thus, the approach to designing the print head can be considered to be reasonably accurate.

Demonstrating LμTP

LμTP provides new capabilities for transfer printing technology. As previously stated, it is substantially independent of the properties and topography of the receiving surface. Hence, it should be possible to print on surfaces with low adhesion energy, structured surfaces where contact area is a small fraction of the surface, and non-flat surfaces. Each of these cases was tested and demonstrated to be feasible. Additionally, the possibility of printing on liquids and gels is also demonstrated. Finally, positional errors for printing on low adhesion energy surfaces are experimentally characterized. The model ink, 100×100×3 micron Si squares, was used for these demonstrations. Further, the printing for these demonstrations was conducted with the pulse time set to 4 ms, and the power level set to 2.5 W.

Figures 20A, 20B, 20C:
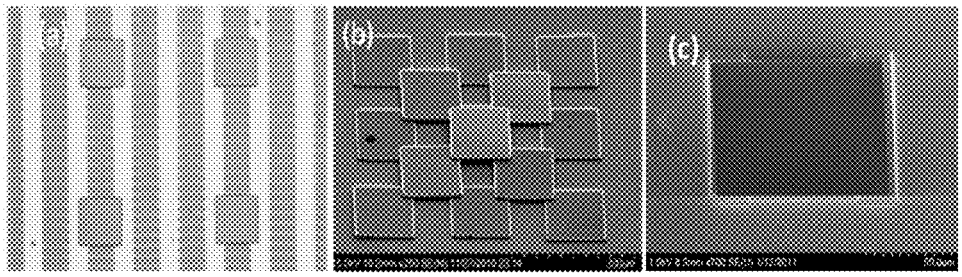
FIGS. 20(A), 20(B), 20(C): Examples of structures constructed by laser micro-transfer printing.

Printing silicon inks on silicon surfaces is generally difficult with flat PDMS stamps because of the low adhesion at the Si—Si interfaces. It is easily accomplished by the LμPT process. FIG. 20(*a*) shows a small array of silicon chips printed onto a silicon substrate to bridge gold traces that were pre-patterned on the surface. FIG. 20(*b*) shows a multi layered structure of silicon squares which would be extremely challenging to achieve with conventional transfer printing as contact is made only at the corners of the squares. FIG. 20(*c*) demonstrates the printing of a silicon chip between two pedestals.

Figure 21:
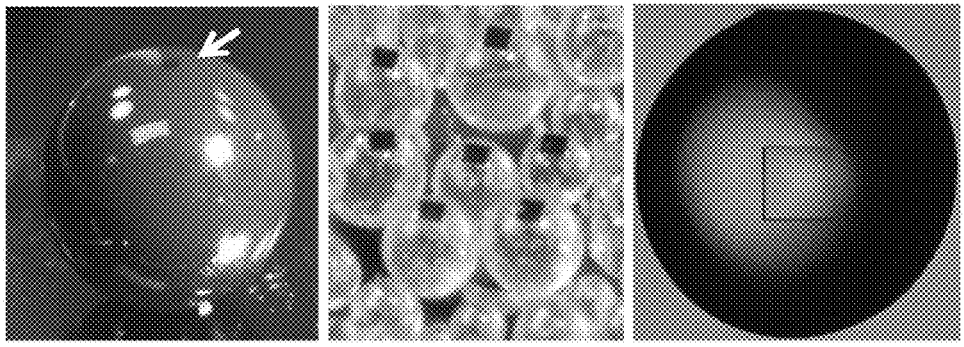
FIG. 21: Examples of printing on curved surfaces, (left) printing on a single 1 mm ceramic sphere, (middle) printing on a non-uniform array of 500 μm silica beads, and (right) printing onto a liquid NOA droplet. (Scale: in all the micrographs, the printed squares have sides of 100 μm).

Printing of inks on non-flat (e.g. spherical) surfaces, including the surface of a liquid droplet, was performed. FIG. 21 shows some results where silicon squares are successfully printed on individual spheres, a non-uniform array of beads and on the surface of a NOA droplet.

Figure 22:
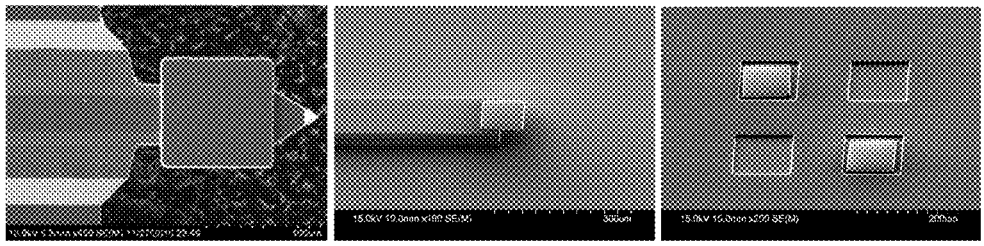
FIG. 22: Examples of printing on partial and recessed surfaces. (Left) A silicon square printed onto an AFM cantilever, demonstrating assembly on an active structure, (Middle) Printing on a ledge, and (right) printing into recessed spaces. (Scale: in all the micrographs, the printed squares have sides of 100 microns).
Figure 23:
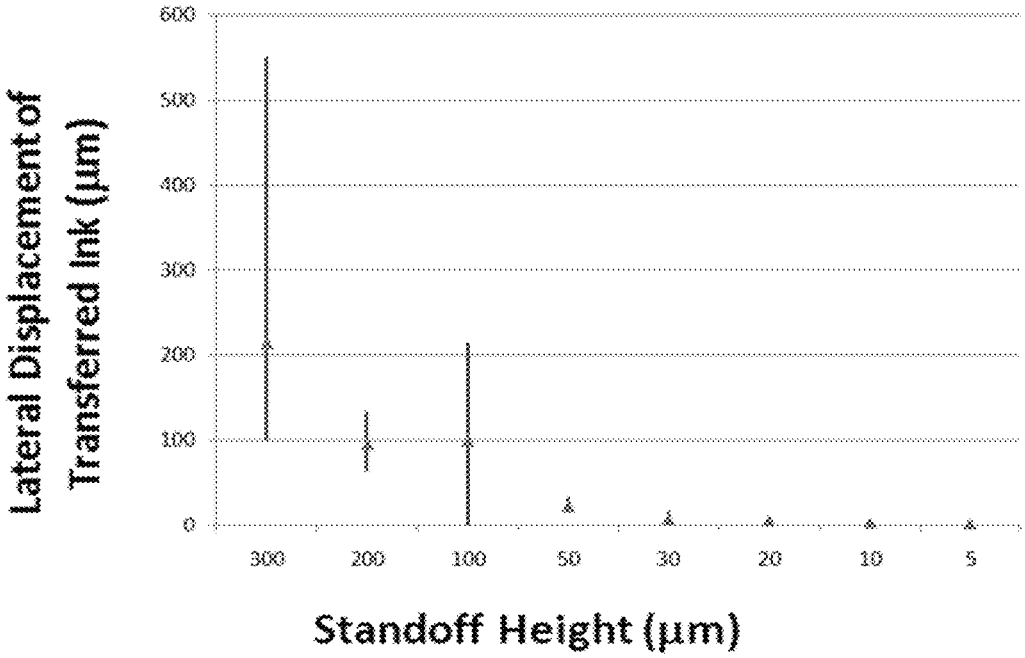
FIG. 23: Lateral transfer errors as a function of stand-off height.

Finally, to demonstrate printing on partial and recessed surfaces, a number of substrates with different features were prepared. FIG. 22 shows examples of printing on ledges, beams and inside concave features. Some of these printing demonstrations exhibit the kind of precise placement that the process is capable of producing. This precision in placement is dependent on a number of set-up factors such as precise centering of the beam on the ink. It is also dependent on process variables, the key variable being the 'stand-off' or distance of the stamp from the receiving substrate. To characterize this dependence, printing was performed at the lowest energy for reliable delamination (4 ms pulses with the power setting at 2.5 W and the same model ink) with different stand-off heights onto a substrate patterned with fiducials. First the stamp is brought in close to the substrate and aligned to the fiducial on the substrate using the optics on the printer (about 1 μm resolution) and the positioning stages (also 1 μm resolution). It is then withdrawn to the appropriate height and transfer printed. The error in the transfer process is obtained through image analysis of frames taken after alignment (with the ink still on the stamp) and after printing. This experiment is conducted for different stand-off heights ranging from 5 μm to 300 μm, with 5 repetitions at each stand-off height. FIG. 23 shows the observed dependence of transfer errors on printing stand-off height. Within the resolution of experimental observations, the transfer errors become insignificant at stand-off heights of about 20 μm.

CONCLUSIONS

In this Example a new mode of transfer printing has been demonstrated and an automated transfer printing machine to implement the new mode was prototyped. In this mode of micro-transfer printing, a laser supplies the energy to drive a thermo-mechanical delamination process that releases the ink from the stamp and transfers it to the receiving substrate. A procedure for designing the print head is developed and verified. This new printing mode, called Laser Micro-Transfer Printing (LμTP), extends the versatility of micro transfer printing by making the process virtually independent of the properties and preparation of the receiving substrate. Thus, printing on low adhesion surfaces, curved, partial and recessed surfaces—operations that are typically difficult in more conventional modes—are easily performed, as demonstrated on a prototype laser micro-transfer printer.

REFERENCES

[1] Kim R, Kim D, Xiao J., Kim B, Park S, Panilaitis B, Ghaffari R, Yao J, Li M, Liu Z., Malyarchuk V, Kim D, Le, A, Nuzzo R G, Kaplan D, Omenetto F, Huang Y, Kang Z, & Rogers J A. (2010) Waterproof AlInGaP optoelectronics on stretchable substrates with applications in biomedicine and robotics. *Nature Materials* 9, 929-937.

[2] Yoon J, A J Baca, A I Park, P Elvikis, J B Geddes, L Li, R H Kim, J Xiao, S Wang, T H Kim, M J Motala, B Y Ahn, E B Duoss, J A Lewis, R G Nuzzo, P M Ferreira, Y Huang, A Rockett and J A Rogers (2008) Ultrathin Silicon Solar Microcells for Semitransparent, Mechanically Flexible and Microconcentrator Module Designs. *Nature Materials* 7, 907-915.

[3] Meitl M A, Zhu Z T, Kumar V, Lee K J, Feng X, Huang Y Y, Adesida I, Nuzzo R G and Rogers J A (2006) Transfer Printing by Kinetic Control of Adhesion to an Elastomeric Stamp. *Nature Materials* 5, 33-38.

[4] Kim S, Wu J, Carlson A, Jin S H, Kovalsky A, Glass P, Liu Z, Ahmed N, Elgan S L, Chen W, Ferreira P M, Sitti M, Huang Y and Rogers J A (2010) Microstructured Elastomeric Surfaces with Reversible Adhesion and Examples of Their Use in Deterministic Assembly by Transfer Printing. *Proceedings of the National Academy of Sciences USA* 107(40), 17095-17100.

[5] Ishikawa F N, Chang H K., Ryu K., Chen P C, Badmaev A, De Arco L G, Shen G, Zhou C (2009) Transparent Electronics Based on Transfer Printed Aligned Carbon Nanotubes on Rigid and Flexible Substrates. *ACS Nano* 3, 73-79.

[6] Bower C A, Menard E, Bonafede E (2010) Active-Matrix OLED Display Backplanes Using Transfer-Printed Microscale Integrated Circuits. *Proceeding of the* 59$^{th}$ *Electronic Component and Technology Conference*, San Diego, Calif., USA.

[7] Lee K J, Meitl M A, Ahn J H, Rogers J A, Nuzzo R G, Kumar V and Adesida I (2006) Bendable GaN High Electron Mobility Transistors on Plastic Substrates. *Journal of Applied Physics* 100(12), 124507-124507-4.

[8] Ko H C, Stoykovich M P, Song J, Malyarchuk V, Choi W M, Yu C J, Geddes J B, Xiao J, Wang S, Huang Y and Rogers J A (2008) A Hemispherical Electronic Eye Camera Based on Compressible Silicon Optoelectronics. *Nature* 454, 748-753.

[9] Hsia K J, Huang Y, Menard E, Park J U, Zhou W, Rogers J A and Fulton J M (2005) Collapse of stamps for soft lithography due to interfacial adhesion. *Applied Physics Letters* 86(15), 1900303.

[10] Huang Y Y, Zhou W X, Hsia K J, Menard W, Park J U, Rogers J A and Alleyne A G (2005) Stamp collapse in soft lithography. *Langmuir* 21(17), 8058-8068.

[11] Mark J E (ed.) (1984), *Polymer Data Handbook*, Oxford University Press, New York.

[12] Okada Y, and Y Tokumaru (1984) Precise determination of lattice parameter and thermal expansion coefficient of silicon between 300 and 1500K. *J. Appl. Phys.,* 56 (2), 314-320.

[13] Bohandy J, B F Kim, and F J Adrian (1986) Metal deposition from a supported metal film using an excimer laser. *Journal of Applied Physics,* 60, 1538.

[14] Holmes A S and S M Saidam (1998) Sacrificial layer process with laser-driven release for batch assembly operations. *Journal of Microelectromechanical Systems,* 7. 4, 416-422.

[15] Wartena R, A E Curtright, C B Arnold, A Piqué, and K E Swider-Lyons (2004) Li-ion Microbatteries Generated by a Laser Direct-Write Method. *Journal of Power Sources,* 126 (1-2), 193-202.

[16] G G Stoney G G (1909) The tension of metallic films deposited by electrolysis. *Proc. R Soc. Lond A* 82, 553, 172-175.

[17] Freund L B and S Suresh (2003) *Thin Film Materials—Stress, Defect Formation, and Surface Evolution*. Cambridge University Press, Cambridge.

[18] Chaudhury, M K and G M Whitesides (1991) Direct measurement of interfacial interactions between semi-spherical lenses and flat sheets of poly(dimethylsiloxane) and their chemical derivatives. *Langmuir,* 7 (5), pp. 1013-1025.

[19] Armani D, C Liu and N Aluru (1999) Re-configurable fluid circuits by PDMS elastomer micromachining. *MEMS '99 Twelfth IEEE International Conference*, Orlando, Fla., 222-227.

[20] Deruelle M, L Leger and M Tirrell (1995) Adhesion at the solid-elastomer interface: influence of the interfacial chains. *Macromolecules* 28, 7419-7428.

[21] Camino G, S M Lomakin, M Lazzari (2001) Polydimethylsiloxane thermal degradation Part 1. Kinetic aspects, *Polymer,* 42, 2395-2402.

[22] http://www.rpgroup.caltech.edu/courses/aph162/2007/Protocols/Optics/e3872_Gaussian-Beam-Optics.pdf

[23] Saeidpourazar R, R Li, Y Li, M D Sangid, C Lü, Y Huang, J A Rogers and P M Ferreira (2011) Laser-driven Non-contact Transfer Printing of Prefabricated Micro-structures. Submitted to *IEEE/ASME J MEMS.*

Example 4: Laser Driven Micro-Transfer Printing Parameters

This Example explores parameters related to laser micro-transfer printing. The setup used for this parametric study directs the beam from the optical cable through the stamp and makes it incident on a photodiode to obtain the incident power/energy. A typical photodiode has two limitations. First, the precalibrated board is slow and cannot be integrated with the set up to be synchronized with the laser pulse. Second, the power range for measurements is limited to about 2.5 W. To overcome these limitations, faster but uncalibrated data-acquisition was used and a 5% optical filter was used to reduce the power. Overlapping measurements were made to relate the pre-calibrated power measurements without the filter to those made with the high-speed data acquisition system with the filter.

Power Required for Delamination

To compute the power incident on the chip (ink), for each experiment reported, power measurements were made with and without the ink on the stamp. The difference provides the energy incident on the ink. Knowing the emissivity, the absorbed energy can be estimated. FIGS. 24(*a*) and 24(*b*) show schematically how the measurements were made. The incident energy is the difference in the area under the power curves of FIGS. 24(*a*) and 24(*b*). Measurements were made by fixing the pulse width and gradually increasing the power level until delamination was achieved. For each of these experiments, 100 micron silicon squares were used as the ink. Pulse widths ranging from 1 ms to 7 ms were tested. Incident energy was calculated using the difference in areas under the power curves of the pulse.

The power required for delamination decreases with pulse width up to a point and then stays constant. After about 4 ms pulses, the minimum power to delaminate stayed the same. This is possibly because the steady state temperature reached for lower power settings was not high enough to produce the energy release rate to overcome the adhesion energy at the interface.

Figure 25A:
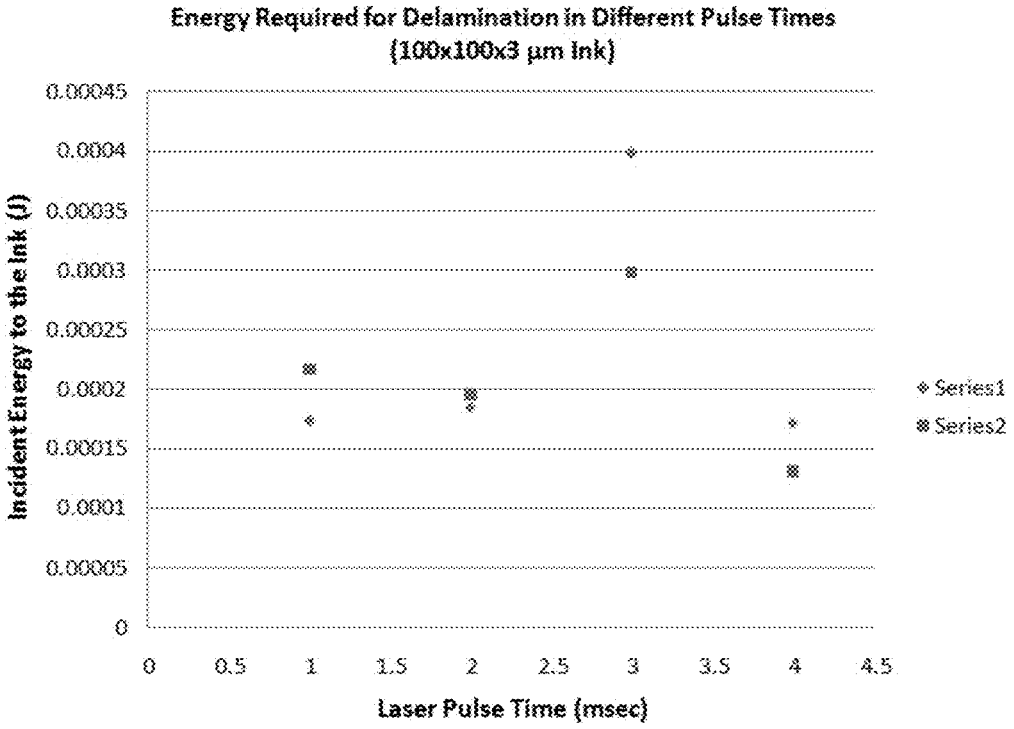
FIGS. 25(A), 25(B), 25(C): Schematic showing the amount of energy required for delamination as a function of FIG. 25(A) pulse width FIG. 25(B) ink thickness and FIG. 25(C) ink size.
Figure 25B:
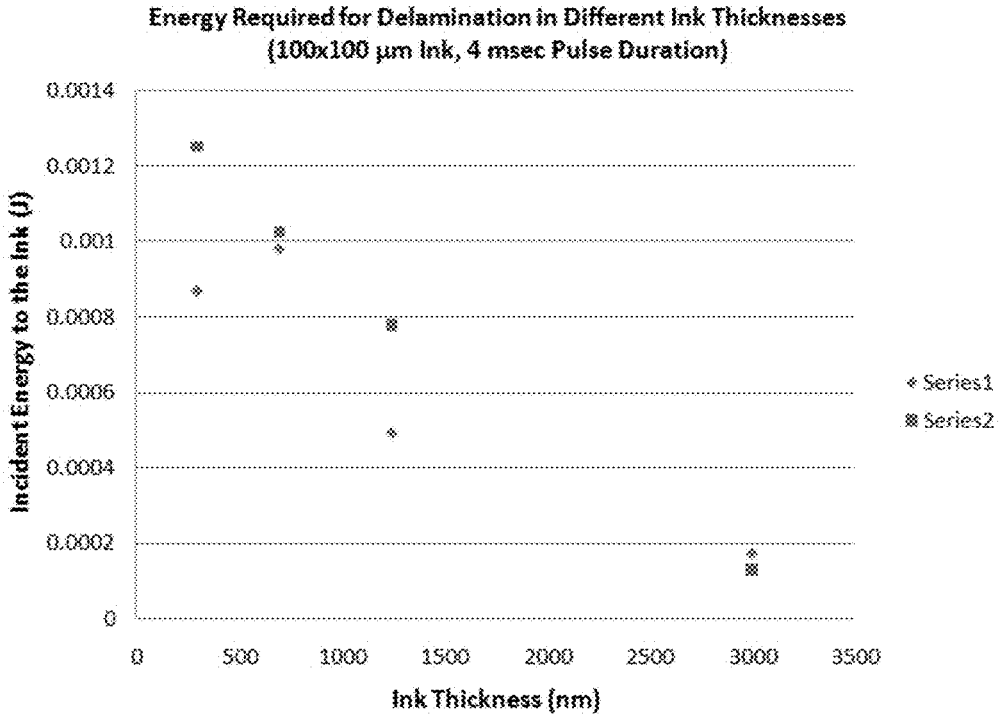
Figure 25C:
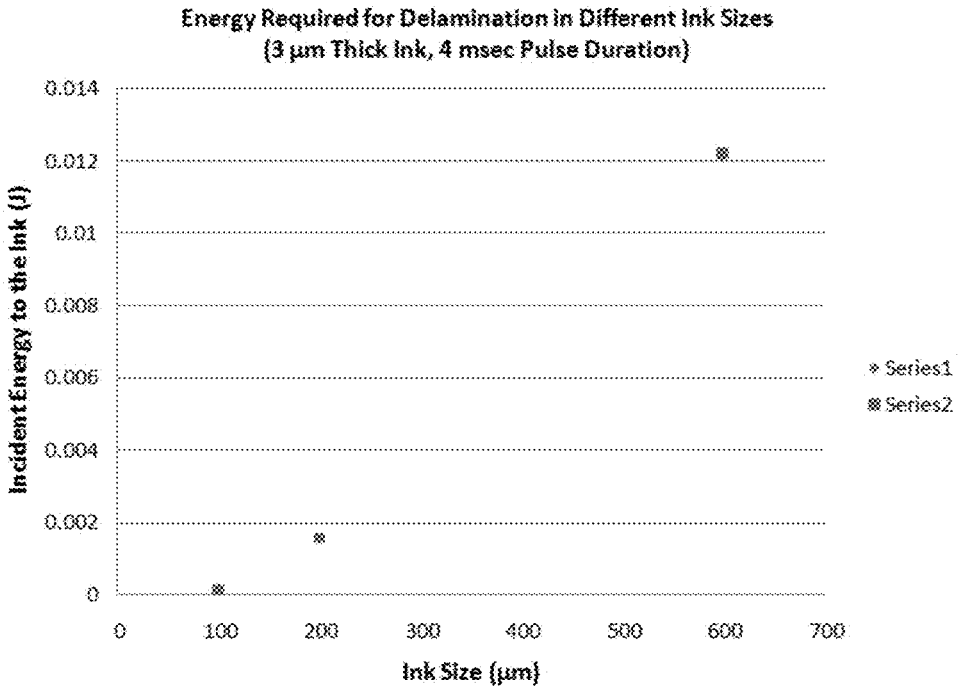

FIG. 25 provides a schematic showing the amount of energy required for delamination as a function of (a) pulse width, (b) ink thickness and (c) ink size.

Effect of Ink Thickness

For these experiments all other factors were kept constant, only the chip (ink) thickness was varied. 100×100 micron chips were subjected to 4 ms laser pulses, where pulse width was shown to be substantially constant. The pulse power was gradually increased until delamination was achieved.

Power measurements were made with and without the chip on the stamp to obtain the energy input into the process (by taking the difference in the area under the power curve). Incident energy may be a misnomer here because transmission losses could be quite high for the thinner chips. Transmitted energy would be captured by the power sensor. Therefore the trend seen must be due to factors other than transmission losses.

The strain energy due to bending that is stored in the chip decreases as the cube of the chip thickness. Therefore the system must be deformed much more to produce the energy release rate needed to overcome the adhesion energy at the interface. Therefore more energy must be input into the system for thinner chips.

Effect of Ink Size

For these experiments all other factors were kept constant, only the chip (ink) size was varied. As shown in FIG. 25(*c*), square chips with varying lateral dimensions and a thickness of 3 microns were subjected to 4 ms laser pulses, where pulse width was shown to be substantially constant. As shown in FIG. 25(*b*), square chips with varying thicknesses were subjected to 4 ms laser pulses.

As shown in FIG. 25(*a*), the pulse power was gradually increased until delamination was achieved. Power measurements were made with and without the chip on the stamp to obtain the energy input into the process (by taking the difference in the area under the power curve). The increase in energy required for delamination rises more sharply than the power in the laser beam. This is because larger chips use a larger fraction of the energy in the beam. A much sharper increase is seen in the incident energy for delamination. This takes into consideration the actual laser flux incident on the chip and channeled into the delamination process. There might be a quadratic relationship between chip dimensions and energy required for delamination.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods can include a large number of optional composition and processing elements and steps.

When a group of substituents is disclosed herein, it is understood that all individual members of that group and all subgroups, including any isomers, enantiomers, and diastereomers of the group members, are disclosed separately. When a Markush group or other grouping is used herein, all individual members of the group and all combinations and subcombinations possible of the group are intended to be individually included in the disclosure. When a compound is described herein such that a particular isomer, enantiomer or diastereomer of the compound is not specified, for example, in a formula or in a chemical name, that description is intended to include each isomer and enantiomer of the compound described individually or in any combination. Additionally, unless otherwise specified, all isotopic variants of compounds disclosed herein are intended to be encompassed by the disclosure. For example, it will be understood that any one or more hydrogens in a molecule disclosed can be replaced with deuterium or tritium. Isotopic variants of a molecule are generally useful as standards in assays for the molecule and in chemical and biological research related to the molecule or its use. Methods for making such isotopic variants are known in the art. Specific names of compounds are intended to be exemplary, as it is known that one of ordinary skill in the art can name the same compounds differently.

The following references relate generally to fabrication methods, structures and systems for making electronic devices, and are hereby incorporated by reference to the extent not inconsistent with the disclosure in this application.

| Application No. | Filing Date | Publication No. | Publication Date | Patent No. | Issue Date |
|---|---|---|---|---|---|
| 11/001,689 | Dec. 1, 2004 | 2006/0286488 | Dec. 21, 2006 | 7,704,684 | Apr. 27, 2010 |
| 11/115,954 | Apr. 27, 2005 | 2005/0238967 | Oct. 27, 2005 | 7,195,733 | Mar. 27, 2007 |
| 11/145,574 | Jun. 2, 2005 | 2009/0294803 | Dec. 3, 2009 | 7,622,367 | Nov. 24, 2009 |
| 12/564,566 | Sep. 22, 2009 | 2010/0072577 | Mar. 25, 2010 | 7,982,296 | Jul. 19, 2011 |
| 13/113,504 | May 23, 2011 | 2011/0220890 | Sep. 15, 2011 | — | — |
| 11/145,542 | Jun. 2, 2005 | 2006/0038182 | Feb. 23, 2006 | 7,557,367 | Jul. 7, 2009 |
| 11/423,287 | Jun. 9, 2006 | 2006/0286785 | Dec. 21, 2006 | 7,521,292 | Apr. 21, 2009 |
| 12/405,475 | Mar. 17, 2009 | 2010/0059863 | Mar. 11, 2010 | — | — |
| 11/675,659 | Feb. 16, 2007 | 2008/0055581 | Mar. 6, 2008 | — | — |
| 11/465,317 | Aug. 17, 2006 | — | — | — | — |
| 11/423,192 | Jun. 9, 2006 | 2009/0199960 | Aug. 13, 2009 | 7,943,491 | May 17, 2011 |
| 11/421,654 | Jun. 1, 2006 | 2007/0032089 | Feb. 8, 2007 | 7,799,699 | Sep. 21, 2010 |
| 12/844,492 | Jul. 27, 2010 | 2010/0289124 | Nov. 18, 2010 | 8,039,847 | Oct. 18, 2011 |
| 11/851,182 | Sep. 6, 2007 | 2008/0157235 | Jul. 3, 2008 | — | — |
| 11/585,788 | Sep. 20, 2007 | 2008/0108171 | May 8, 2008 | 7,932,123 | Apr. 26, 2011 |
| 13/071,027 | Mar. 24, 2011 | 2011/0171813 | Jul. 14, 2011 | — | — |
| 13/228,041 | Sep. 8, 2011 | — | — | — | — |
| 11/981,380 | Oct. 31, 2007 | 2010/0283069 | Nov. 11, 2010 | 7,972,875 | Jul. 5, 2011 |
| 13/100,774 | May 4, 2011 | — | — | — | — |
| 12/669,287 | Jan. 15, 2010 | 2011/0187798 | Aug. 4, 2011 | — | — |
| 12/418,071 | Apr. 3, 2009 | 2010/0052112 | Mar. 4, 2010 | — | — |
| 12/398,811 | Mar. 5, 2009 | 2010/0002402 | Jan. 7, 2010 | — | — |
| 12/996,924 | Dec. 8, 2010 | 2011/0147715 | Jun. 23, 2011 | — | — |
| 13/120,486 | Aug. 4, 2011 | — | — | — | — |
| 12/778,588 | May 12, 2010 | 2010/0317132 | Dec. 16, 2010 | — | — |
| 12/968,637 | Dec. 15, 2010 | — | — | — | — |
| 12/947,120 | Nov. 16, 2010 | 2011/0170225 | Jul. 14, 2011 | — | — |
| 12/916,934 | Nov. 1, 2010 | — | — | — | — |
| 13/046,191 | Mar. 11, 2011 | — | — | — | — |

It must be noted that as used herein and in the appended claims, the singular forms "a", "an", and "the" include plural reference unless the context clearly dictates otherwise. Thus, for example, reference to "a cell" includes a plurality of such cells and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are now described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements, limitation or limitations which is not specifically disclosed herein.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

We claim:

1. A method of transferring ink from a donor substrate to a receiving substrate, said method comprising:

providing a non-ablative transfer device having a transfer surface;

providing said donor substrate having a donor surface, said donor surface having ink thereon, wherein said ink is a micro-sized or nano-sized prefabricated electronic, optical, or electro-optical device or device component thereof;

contacting at least a portion of said transfer surface with at least a portion of said ink;

separating said transfer surface from said donor surface, wherein said ink is transferred from said donor surface to said transfer surface;

positioning said transfer surface having said ink disposed thereon into alignment with a receiving surface of said receiving substrate; and actuating said transfer device, said ink, or both of said transfer device and said ink by generating a non-ablative force that releases at least a portion of said ink from said transfer surface, thereby transferring said ink to said receiving surface, wherein said step of actuating comprises mechanically stressing an interface between said transfer surface and said ink so as to cause delamination, thereby resulting in release of said ink.

2. The method of claim 1, wherein a gap remains between said ink disposed on said transfer surface and said receiving surface during the actuation.

3. The method of claim 1, wherein the non-ablative actuation force is generated while maintaining at least a portion of said gap.

4. The method of claim 1, wherein said ink is in contact with the receiving surface during the actuation.

5. The method of claim 1, wherein the actuation is electrostatic.

6. The method of claim 1, wherein said step of actuating said transfer device uses a laser, a piezoelectric actuator, a gas source, a vacuum source, an electromagnetic source, an electrostatic source, an electronic source, a heat or thermal source, or a combination thereof.

7. The method of claim 6, wherein said electrostatic source generates an applied electric field on said transfer surface, said ink disposed on said transfer surface, or both.

8. The method of claim 6, wherein the actuation is thermal.

9. The method of claim 8, wherein the thermal actuation is enabled by providing electromagnetic radiation.

10. The method of claim 9, wherein the electromagnetic radiation is infrared radiation.

11. The method of claim 6, wherein said heat source heats said transfer device, said ink, or both of said transfer device and said ink, thereby thermally actuating said transfer device, said ink, or both of said transfer device and said ink.

12. The method of claim 11, wherein said heat source produces a temperature of said transfer surface selected from the range of 275 degrees C. to 325 degrees C.

13. The method of claim 6, wherein said heat source produces a temperature gradient in said transfer device selected from the range of $10^4$ degrees C. per cm to $10^5$ degrees C. per cm.

14. The method of claim 1, wherein the magnitude and spatial distribution of said force is selected so as to generate a separation energy between said ink and said transfer surface equal to or greater than 1 J/meter$^2$.

15. The method of claim 1, wherein the prefabricated device or device component is a semiconductor element.

16. The method of claim 1, wherein the prefabricated device or device component is a light-emitting diode.

17. The method of claim 1, wherein the prefabricated device or device component has a lateral dimension in the range of 100 nm to 100 microns.

18. The method of claim 1, wherein the transfer device is an elastomeric stamp.

19. The method of claim 1, wherein at least a portion of said transfer surface directly contacts at least a portion of said ink.

20. A method of transferring ink from a donor substrate to a receiving substrate, said method comprising:

providing a non-ablative transfer device having a transfer surface;

providing said donor substrate having a donor surface, said donor surface having ink thereon, wherein said ink is a micro-sized or nano-sized prefabricated electronic, optical, or electro-optical device or device component thereof;

contacting at least a portion of said transfer surface with at least a portion of said ink;

separating said transfer surface from said donor surface, wherein said ink is transferred from said donor surface to said transfer surface;

positioning said transfer surface having said ink disposed thereon into alignment with a receiving surface of said receiving substrate; and actuating said transfer device, said ink, or both of said transfer device and said ink by generating a non-ablative force that releases at least a portion of said ink from said transfer surface, thereby transferring said ink to said receiving surface, wherein said step of actuating comprises electrostatic actuation.

21. The method of claim 20, wherein a gap remains between said ink disposed on said transfer surface and said receiving surface during the actuation.

22. The method of claim 20, wherein the non-ablative actuation force is generated while maintaining at least a portion of said gap.

23. The method of claim 20, wherein said ink is in contact with the receiving surface during the actuation.

24. The method of claim 20, wherein said electrostatic source generates an applied electric field on said transfer surface, said ink disposed on said transfer surface, or both.

25. The method of claim 20, wherein the magnitude and spatial distribution of said force is selected so as to generate a separation energy between said ink and said transfer surface equal to or greater than 1 J/meter$^2$.

26. The method of claim 20, wherein the prefabricated device or device component is a semiconductor element.

27. The method of claim 20, wherein the prefabricated device or device component is a light-emitting diode.

28. The method of claim 20, wherein the prefabricated device or device component has a lateral dimension in the range of 100 nm to 100 microns.

29. The method of claim 20, wherein the transfer device is an elastomeric stamp.

30. The method of claim 20, wherein at least a portion of said transfer surface directly contacts at least a portion of said ink.

* * * * *